US008388454B2

(12) United States Patent
Kido

(10) Patent No.: US 8,388,454 B2
(45) Date of Patent: Mar. 5, 2013

(54) GAMING MACHINE CAPABLE OF PROTECTING CONTROL UNIT AGAINST CHEATING AND TAMPERING

(75) Inventor: Katsuhiro Kido, Koto-ku (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 375 days.

(21) Appl. No.: 12/550,694

(22) Filed: Aug. 31, 2009

(65) Prior Publication Data

US 2010/0062861 A1 Mar. 11, 2010

Related U.S. Application Data

(60) Provisional application No. 61/096,180, filed on Sep. 11, 2008, provisional application No. 61/096,187, filed on Sep. 11, 2008.

(51) Int. Cl.
*A63F 9/24* (2006.01)

(52) U.S. Cl. ..... 463/46

(58) Field of Classification Search ..... 463/16, 463/20, 42, 43, 46
See application file for complete search history.

(56) References Cited

U.S. PATENT DOCUMENTS

| | | | | |
|---|---|---|---|---|
| 5,951,131 | A * | 9/1999 | Stefan | 312/257.1 |
| 6,135,884 | A * | 10/2000 | Hedrick et al. | 463/20 |
| 6,220,594 | B1 | 4/2001 | Peng | |
| 6,251,014 | B1 * | 6/2001 | Stockdale et al. | 463/16 |
| 6,688,984 | B2 * | 2/2004 | Cole | 463/46 |
| 6,939,229 | B2 * | 9/2005 | McClintic | 463/25 |
| 6,997,810 | B2 * | 2/2006 | Cole | 463/46 |
| 7,267,613 | B2 * | 9/2007 | Cole | 463/20 |
| 7,513,830 | B2 * | 4/2009 | Hajder et al. | 463/46 |
| 7,846,026 | B2 * | 12/2010 | Stephenson et al. | 463/46 |
| 7,862,435 | B1 * | 1/2011 | Schreiber | 463/46 |
| 8,016,683 | B2 * | 9/2011 | Cole | 463/46 |
| 8,088,013 | B2 * | 1/2012 | Abe et al. | 463/46 |
| 2001/0053712 | A1 * | 12/2001 | Yoseloff et al. | 463/1 |
| 2002/0025850 | A1 * | 2/2002 | Hafezi | 463/29 |
| 2002/0052230 | A1 * | 5/2002 | Martinek et al. | 463/10 |
| 2002/0107067 | A1 * | 8/2002 | McGlone et al. | 463/20 |
| 2002/0183106 | A1 | 12/2002 | Cole | |
| 2003/0162591 | A1 | 8/2003 | Nguyen et al. | |
| 2004/0097285 | A1 * | 5/2004 | Fisher et al. | 463/24 |
| 2004/0166927 | A1 * | 8/2004 | Okada | 463/20 |
| 2004/0209682 | A1 * | 10/2004 | Okada | 463/31 |
| 2004/0209683 | A1 * | 10/2004 | Okada | 463/31 |
| 2005/0113172 | A1 * | 5/2005 | Gong | 463/42 |
| 2005/0255924 | A1 * | 11/2005 | Cole | 463/46 |

(Continued)

FOREIGN PATENT DOCUMENTS

JP 2003-79919 3/2003

OTHER PUBLICATIONS

International-Style Search Report and Office Action issued Dec. 1, 2010, in Macao Patent Application No. I/000980
U.S. Appl. No. 12/776,662, filed May 10, 2010, Kido.
U.S. Appl. No. 12/777,539, filed May 11, 2010, Kido.

*Primary Examiner* — Dmitry Suhol
*Assistant Examiner* — Jason Skaarup
(74) *Attorney, Agent, or Firm* — Lexyoume IP Meister, PLLC.

(57) ABSTRACT

A gaming machine 1 includes: a cabinet 2; a top door 3 that is openable and closable, and disposed on an upper portion T of the cabinet 2; and a main display 31 that is disposed on the top door 3 and performs display related to a game. In addition, the cabinet 2 has a main housing portion 22 that houses a control unit 61 and a sub housing portion 21 that is provided between the top door 3 and the main housing portion 22. In the sub housing portion 21, a relay portion (211) that relays a connection of the main display 3 and a control unit 61.

6 Claims, 17 Drawing Sheets

U.S. PATENT DOCUMENTS

2005/0266905 A1* 12/2005 Emori et al. ..... 463/1
2006/0073900 A1* 4/2006 Cole ..... 463/46
2007/0026947 A1 2/2007 Chun
2007/0054731 A1* 3/2007 Okada ..... 463/25
2007/0060267 A1* 3/2007 Okada ..... 463/16
2008/0096641 A1 4/2008 Yoshizawa
2008/0113820 A1 5/2008 Tedsen et al.
2008/0176657 A1* 7/2008 Okada ..... 463/42

* cited by examiner

GAMING MACHINE CAPABLE OF PROTECTING CONTROL UNIT AGAINST CHEATING AND TAMPERING

CROSS REFERENCE TO RELATED APPLICATIONS

This application claims benefit of U.S. Provisional Application Nos. 61/096,187, filed Sep. 11, 2008, and 61/096,180, filed Sep. 11, 2008, the entire contents of which are incorporated herein by reference.

BACKGROUND OF THE INVENTION

1. Field of the Invention

The present invention relates to a gaming machine that can protect a control unit thereof against tampering and a foreign matter getting thereinto.

2. Related Art

Conventionally, gaming machines that execute various table games are known. Among these gaming machines, there are machines in which the games are hosted by a dealer, and machines in which the games are hosted by a computer in place of the dealer.

In such a gaming machine, for example, in a case where a display is provided on an upper face side thereof, as with a gaming machine disclosed in U.S. Patent No. 2007/0026947, a control unit that controls the game is housed inside a cabinet, below the display and an operating unit.

With such a gaming machine, there was a problem in that, if a player playing a game while drinking a beverage spilled the beverage on the gaming machine, liquid may enter a portion housing the control unit through a narrow gap between the display or the operating unit and the cabinet, and lead to a serious problem such as breakdown of the control unit.

In addition, since a player can easily access the control unit by removing the display and the operating unit, there has been a problem in that the control unit is highly likely to be tampered.

Given this, the present invention aims at providing a gaming machine that can protect a control unit thereof against tampering and foreign matter getting thereinto.

Moreover, in a gaming machine, various rendering devices such as speakers, lamps and the like are provided in order to enhance a rendered effect.

Here, the rendering devices of the gaming machine installed in a hall and the like have often been subject to various destructive acts. Such a destructive act includes, for example, a malicious act of inserting foreign matter into a perforation for emitting sound in a speaker, and destruction of a decorative member made of resin, which is weak relative to other parts in the cabinet.

In a case where a part of the gaming machine is destroyed by such a destructive act, or where a lamp for decoration is out due to the end of the life span thereof and the like, replacement of the part or the lamp is necessary.

In such a case, since the speaker and the lamp for decoration do not affect progression of a game, the gaming machine itself can continue operating. However, in a case of repair or maintenance of the gaming machine, it is necessary to temporarily stop operation of the gaming machine.

Particularly, for a gaming machine installed in a hall such as a 24-hour casino, it is difficult to frequently perform repair or maintenance. In addition, repair or maintenance must be performed in a short period of time where a player is not playing a game thereon, or by asking a player playing a game to temporarily stop playing thereon.

On the other hand, in a case of such a gaming machine, the same cabinet may be used for different kinds of games. In such a case, a gaming machine is desired in which decorations such as a lamp and an optional module can be easily replaced in accordance with a game being provided thereon.

Given this, the present invention aims at providing a gaming machine with high versatility that can be easily repaired or maintained.

SUMMARY OF THE INVENTION

In a first aspect of the present invention, a gaming machine comprising: a cabinet; a door that is disposed to be openable and closable, and disposed on an upper portion of the cabinet; a display device that visually, or auditorily and visually, presents information related to a game on a surface side of the door according to electrical control; a control unit that is electrically connected with the display device via a signal line cable transmitting an electrical signal, executes a game based on a game program, and transmits an electrical signal for controlling the display device via the signal line cable in order to perform display according to a result of performing the game; an input device that is connected with the control unit and can accept input related to a game; a relay portion, which is a dummy of the control unit, disposed at a relay position along the signal line cable that connects the control unit with the display device; a sub housing portion that houses the relay portion, in a state which is visually recognizable from the opening, at a position close to an opening of the door in a case in which the door is opened; and a main housing portion that is disposed at a side of the sub housing portion that is opposite to a side thereof on which the opening is formed, and houses the control unit, wherein the sub housing portion and the main housing portion are divided by a dividing board that forms a bottom face of the sub housing portion other than a portion through which the signal line cable passes, and the opening, the sub housing portion, and the main housing portion are disposed so as to be stacked in a downward direction in this order.

In a second aspect of the present invention, a gaming machine includes: a cabinet that houses devices which execute a game; a top door that is openable and closable, and disposed on an upper portion of the cabinet; a display that is disposed on the top door and performs display related to the game, and a control unit for executing the game, in which: the cabinet includes a main housing portion that houses the control unit and a sub housing portion that is provided between the main housing portion and the top door, and houses a relay portion that relays the display to the control unit.

According to the second aspect of the present invention, the gaming machine includes: a cabinet; a top door that is openable and closable, and disposed on an upper portion of the cabinet; and a display that is disposed on the top door and performs display related to a game. In addition, the cabinet includes a main housing portion that houses a control unit and a sub housing portion that is provided between the main housing portion and the top door. In the sub housing portion, a relay portion is provided that relays the display to a control unit.

In such a configuration, even in a case where the top door is forced open, since the sub housing portion that houses the relay portion is provided between the top door and the main housing portion, the control unit can be prevented from being directly accessed. This can protect the control unit against tampering to somehow manipulate the control unit. In addition, even in a case where a foreign matter gets into a cabinet from the top door, the foreign matter enters only the sub housing portion and is prevented from directly affecting the control unit.

According to a third aspect of the present invention, the gaming machine as described in the second aspect further includes on the top door, a device that operates based on a signal from the control unit and a device that transmits a signal to the control unit, in which the device that operates and the device that transmits are connected to the control unit via the relay portion.

According to a third aspect of the present invention, the gaming machine as described in the second aspect includes, on the top door, a device that operates based on a signal from the control unit and a device that transmits a signal to the control unit. These devices are connected to the control unit via the relay portion. In such a configuration, since the devices provided on the top door are connected to the control unit via the relay portion, these devices can be accessed only by opening the top door in a case of repair or replacement thereof.

According to a fourth aspect of the present invention, the gaming machine as described in the second aspect further includes an operating unit that is operable by a player, in which the operating unit is connected to the control unit via the relay portion.

According to the fourth aspect of the present invention, in addition to the gaming machine described in the second aspect, the operating unit, which is connected to the control unit via the relay portion, is further provided.

In such a configuration, the operating unit can be made ready for repair or replacement, for example, by only opening the top door and disconnecting from the relay portion. This facilitates maintenance of the gaming machine.

According to a fifth aspect of the present invention, the gaming machine as described in the second aspect further includes a rendering portion that generates light and sound based on a signal from the control unit, in which the rendering portion is connected to the control unit via the relay portion.

According to the fifth aspect of the present invention, in addition to the gaming machine described in the second aspect, the rendering portion, which generates light and sound, and is connected to the control unit via the relay portion, is further provided.

In such a configuration, the rendering portion can be made ready for repair or replacement, for example, only by opening the top door and disconnecting from the relay portion. This facilitates replacement of the rendering portion, for example, in a case where various rendering portions are developed for games provided on the gaming machine. This also facilitates maintenance of the gaming machine.

In a sixth aspect of the present invention, a gaming machine includes: a cabinet that houses devices for playing a game; a display that performs display related to the game; a top door that is openable and closable, and in which the display is disposed; a control unit that executes the game; an application unit that is disposed on the cabinet, operates in response to a signal from the control unit, and is detachable; and a connection portion that electrically connects the control unit with the application unit.

According to the sixth aspect of the present invention, the gaming machine includes a cabinet, a display, a top door, a control unit, and an application unit. The application unit can be disposed to be detachable on the cabinet, and operates in response to a signal from the control unit. The control unit and the application unit are electrically connected to each other by the connection portion. In such a configuration, in a case where a device provided in the application unit has failed, it is only required to remove and replace the application unit, thereby allowing for easy maintenance in a short period of time. In addition, since the application units are prepared to correspond to a game provided on the gaming machine, and it is possible to match to different games by only replacing thereof, the versatility of the gaming machine can be improved.

In a seventh aspect of the present invention, a gaming machine includes: a cabinet; a top door that is openable and closable, and disposed on an upper portion of the cabinet; a display that is disposed on an upper face of the top door so as to be tilted toward a front face side of the cabinet, and performs display related to a game; a control unit that executes the game; and an application unit that is detachable, and operates in response to a signal from the control unit, in which the cabinet includes: a main housing portion that houses the control unit; and a connection portion that is disposed between the main housing portion and the top door, and electrically connects the control unit with the application unit, and in which the application unit is provided in a back face side end portion of an upper face of the cabinet.

According to the seventh aspect of the present invention, the gaming machine includes at least: a cabinet; a top door that is openable and closable; a display that is disposed on the top door; a control unit that executes a game; and an application unit that is detachable, and operates in response to a signal from the control unit. In addition, the cabinet includes a main housing portion that houses a control unit and a connection portion that is disposed between the main housing portion and the top door, and electrically connects the control unit with the application unit. The application unit is provided in a back face end portion of an upper face of the cabinet, and is electrically connected with the control unit via the connection portion.

In such a configuration, in a case where a device provided in the application unit has failed, it is only necessary to remove and replace the application unit, thereby allowing for easy maintenance in a short period of time. In addition, since the application units are prepared to correspond to a game provided on the gaming machine, and it is possible to match to different games by only replacing thereof, the versatility of the gaming machine can be improved. Furthermore, since the application unit is provided in a back face side end portion on of an upper face of the cabinet, the application unit is provided on a side opposite to a side on which a player is seated while playing a game. In such a configuration, for example, the application unit can be removed for replacement or the like, even when a player is playing a game.

According to a eighth aspect of the present invention, in the gaming machine as described in the sixth aspect, the application unit includes a speaker.

According to the eighth aspect of the present invention, in addition to the gaming machine described in the sixth aspect, the application unit has a speaker. This can add a function of outputting sound to the gaming machine. In order to output sound, a speaker has a weaker structure compared to other parts of the cabinet, and therefore is easily damaged by, for example, foreign matter inserted thereinto. However, since the speaker is provided in the application unit, even if the speaker is damaged or foreign matter is inserted thereinto, maintenance thereof can easily be done by simply replacing the application unit.

According to a ninth aspect of the present invention, in the gaming machine as described in the sixth aspect, the application unit includes a lamp.

According to the ninth aspect of the present invention, in addition to the gaming machine described in the sixth aspect, the application unit has a lamp. This can add a function of outputting light to the gaming machine. In addition, in a case where a lamp is out due to the end of the life span thereof, or where a lamp is to be replaced according to a game provided by the gaming machine, the lamp can easily be replaced.

According to a tenth aspect of the present invention, in the gaming machine as described in the sixth aspect, the application unit includes a sub display that is different from the display.

According to the tenth aspect of the present invention, in addition to the gaming machine described in the sixth aspect, the application unit has a sub display. As a result, it is possible to provide a game or information using 2 display surfaces by a combination thereof with the display disposed in the cabinet.

According to an eleventh aspect of the present invention, in the gaming machine as described in the seventh aspect, the application unit includes a speaker.

According to the eleventh aspect of the present invention, in addition to the gaming machine described in the seventh aspect, the application unit has a speaker. This can add to the gaming machine a function of outputting sound. For outputting sound, a speaker has a weaker structure compared to other parts of the cabinet, and therefore is easily damaged by, for example, inserting foreign matter thereinto. However, since the speaker is provided in the application unit, even if the speaker is damaged or foreign matter is inserted thereinto, maintenance thereof can easily be done by simply replacing the application unit.

According to a twelfth aspect of the present invention, in the gaming machine as described in the seventh aspect, the application unit includes a lamp.

According to the twelfth aspect of the present invention, in addition to the gaming machine described in the seventh aspect, the application unit has a lamp. This can add to the gaming machine a function of outputting light. In addition, in a case where a lamp is out due to the end of the life span thereof, or where a lamp is to be replaced according to a game provided by the gaming machine, the lamp can be easily replaced.

According to an thirteenth aspect of the present invention, in the gaming machine as described in the seventh aspect, the application unit includes a sub display that is different from the display.

According to the thirteenth aspect of the present invention, in addition to the gaming machine described in the seventh aspect, the application unit has a sub display. As a result, it is possible to provide a game or information using 2 display surfaces by a combination thereof with the display disposed in the cabinet.

DETAILED DESCRIPTION OF THE INVENTION

An embodiment of the present invention is described hereinafter with reference to the accompanying drawings.

Overall Summary

Figure 1:
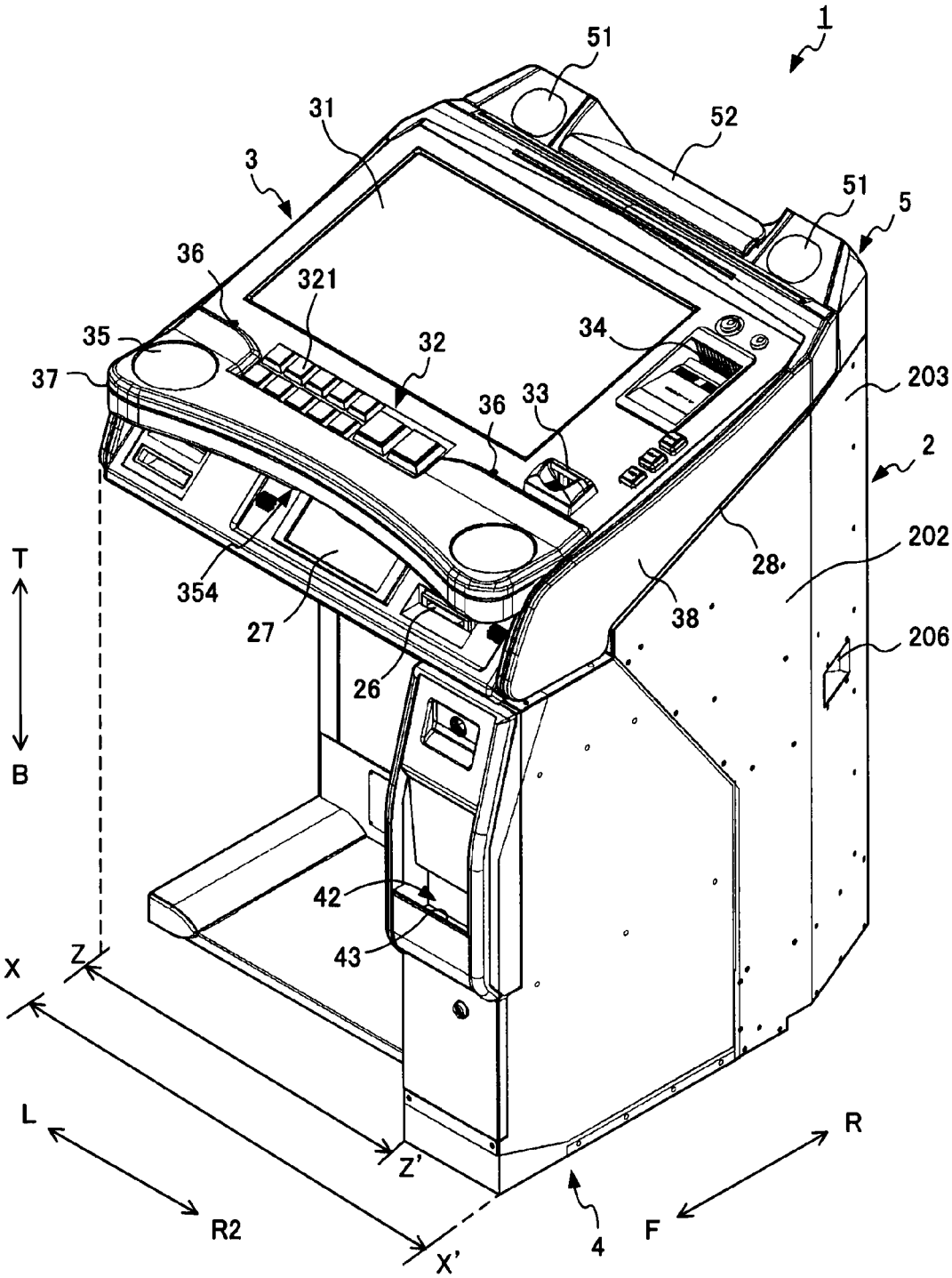
FIG. 1 is a perspective view showing the gaming machine according to an embodiment of the present invention.
Figure 2:
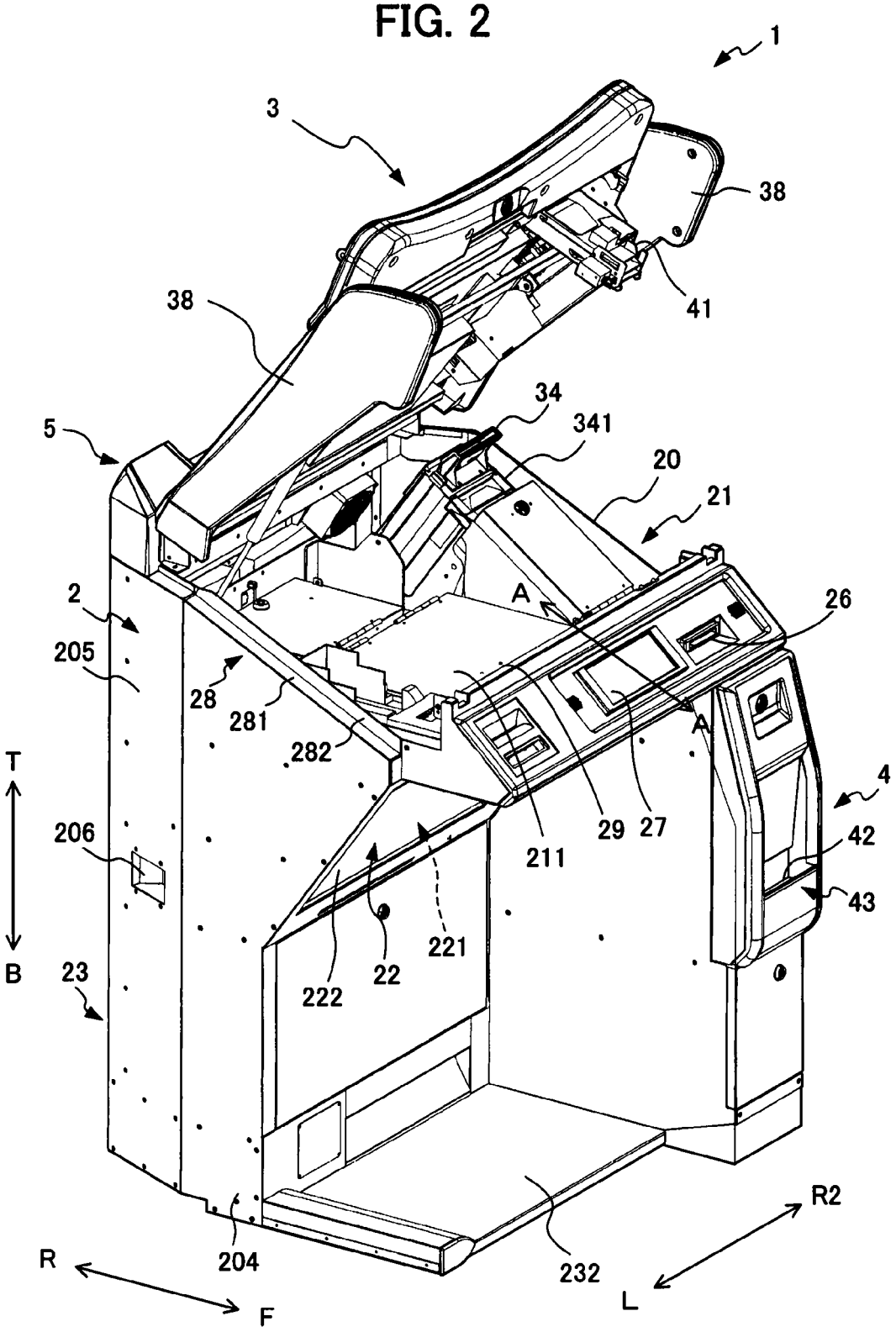
FIG. 2 is a perspective view showing the gaming machine according to the embodiment of the present invention with an top door being open.
Figure 3:
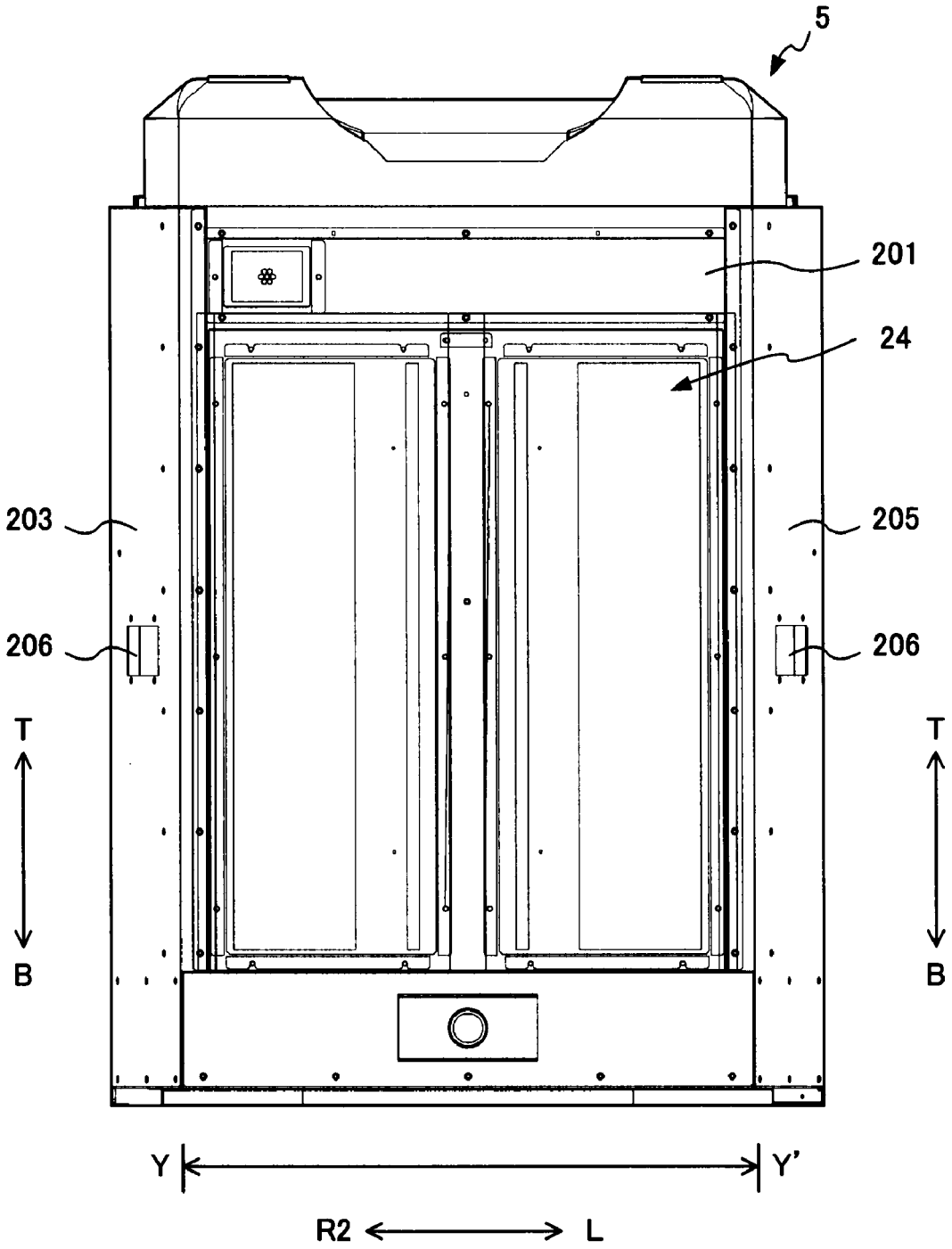
FIG. 3 is a back view showing the gaming machine according to the embodiment of the present invention.

An embodiment of the gaming machine according to the present invention is described hereinafter with reference to the accompanying drawings. First, an overall configuration of a gaming machine 1 according to the present embodiment is described with reference to FIGS. 1 to 3. FIG. 1 is a perspective view of the gaming machine 1. FIG. 2 is a perspective view showing the gaming machine 1 with a top door 3 being open. FIG. 3 is a back view of the gaming machine 1.

The gaming machine 1 is composed of: a cabinet 2 as a housing that houses a circuit substrate and the like; a top door 3 in which a main display 31, an operating unit 32 and the like are disposed; a hopper unit 4 that is a retaining device for medals and coins, and discharges the medals and coins; and an application unit 5 that can be attached and removed, to which a speaker 51, a lamp portion 52, and the like are disposed.

The cabinet 2 houses a circuit substrate and the like, and constitutes a main body of the gaming machine 1. The cabinet 2 includes a sub housing portion 21 formed on a lower side (a lower side in the drawings is hereinafter referred to as a lower side B) of the top door 3, a main housing portion 22 formed on the lower side B of the sub housing portion 21, and a supporting portion 23 formed on a further lower side of the main housing portion 22. The sub housing portion 21 houses a relay board unit 211 (described later) and a human body detection sensor 29, which is the first sensor. In addition, the main housing portion 22 houses a main control unit 221 (described later).

An opening portion 20 is formed on an upper side T (an upper side in the drawings is hereinafter referred to as an upper side T) of the sub housing portion 21. In the present embodiment, the opening portion 20 constitutes an entirety of the upper side T of the cabinet 2; in other words, the entirety of the upper side T of the sub housing portion 21 is open.

A card insertion opening 26 into which a player card, which is an information storage medium for a PTS (player tracking system), is inserted, and a player information display portion 27 for displaying information stored on the player card inserted are provided on a front side F (a front side in the drawings is hereinafter referred to as a front side F) of the sub housing portion 21, which is a front side F of the cabinet 2. The player card stores information related to a player such as a player ID, and the player information displaying portion 27 displays history information of the player, who owns the player card inserted into the card insertion opening 26. In the present embodiment, the player card also stores a play history.

In addition, in the cabinet 2, a foot lamp 25 is provided on the front side F of the cabinet 2 and on the lower side B of the main housing portion 22. The foot lamp 25 is disposed on the front side F of the supporting portion 23. The foot lamp 25 emits light toward the lower side B and irradiates a region corresponding to feet of a player in a case where the player is seated in front of the gaming machine 1.

A supporting plate 232 is provided on the lower side B of the cabinet 2. The supporting plate 232 is disposed on the lowermost side B of the cabinet 2 so as to project from an end portion on the lower side B of the supporting portion 23 toward the front side F.

In addition, as shown in FIG. 3, a cabinet illuminating portion 24 is provided on a back side (a back side in the drawings is hereinafter referred to as a back side F) of the cabinet 2. The cabinet illuminating portion 24 emits light or switches between modes of illumination in accordance with a control signal from the main control unit 221.

The top door 3 is disposed on the upper side T of the cabinet 2 so as to cover an entirety of the opening portion 20 formed on the sub housing portion 21 of the cabinet 2. The top door 3 is disposed so as to cover the upper side T of the cabinet 2 like a lid and opens and closes rotationally on an end thereof on the back side R (see FIG. 2).

In addition, the top door 3 includes: a main display 31 for displaying mainly images related to the game; an operating unit 32 on which a player performs operations related to the game; a coin slot 33 into which coins are inserted; and a bill slot 34 into which bills are inserted (see FIG. 1).

A hopper unit 4 is disposed on the lower side B of the top door 3 and the sub housing portion 21, to a right side of the cabinet 2 (a right side of the cabinet is hereinafter referred to as a right side R2). The hopper unit 4 constitutes a face on the right side R2 of the cabinet 2, namely a face on the right side R2 of the gaming machine 1. The hopper unit 4 is provided as an independent body from the cabinet 2 and connected to the cabinet 2 via an opening portion for a hopper (not shown) provided on a face on the lower side B of the sub housing portion 21.

The hopper unit 4 is formed in a vertically long shape, which is elongated in a thickness direction (F-R direction). In addition, a coin payout opening 42 is formed on the front side F of the hopper unit 4, and coins discharged from the coin payout opening 42 are collected in the coin tray 43.

An application unit 5 is disposed on the upper side T, in an end on the back face side R, of the cabinet 2. An application unit 5 is disposed on the upper side T, in an end on the back face side R, of the cabinet 2.

In the present embodiment, the application unit 5 includes a speaker 51 and a lamp portion 52 (see FIG. 1). In other words, in the gaming machine 1, the speaker 51 and the lamp portion 52, as a unit, are formed to be detachable (details are described later).

Functional Configuration

A circuit configuration of the gaming machine 1 is described hereinafter with reference to FIG. 4.

Figure 4:
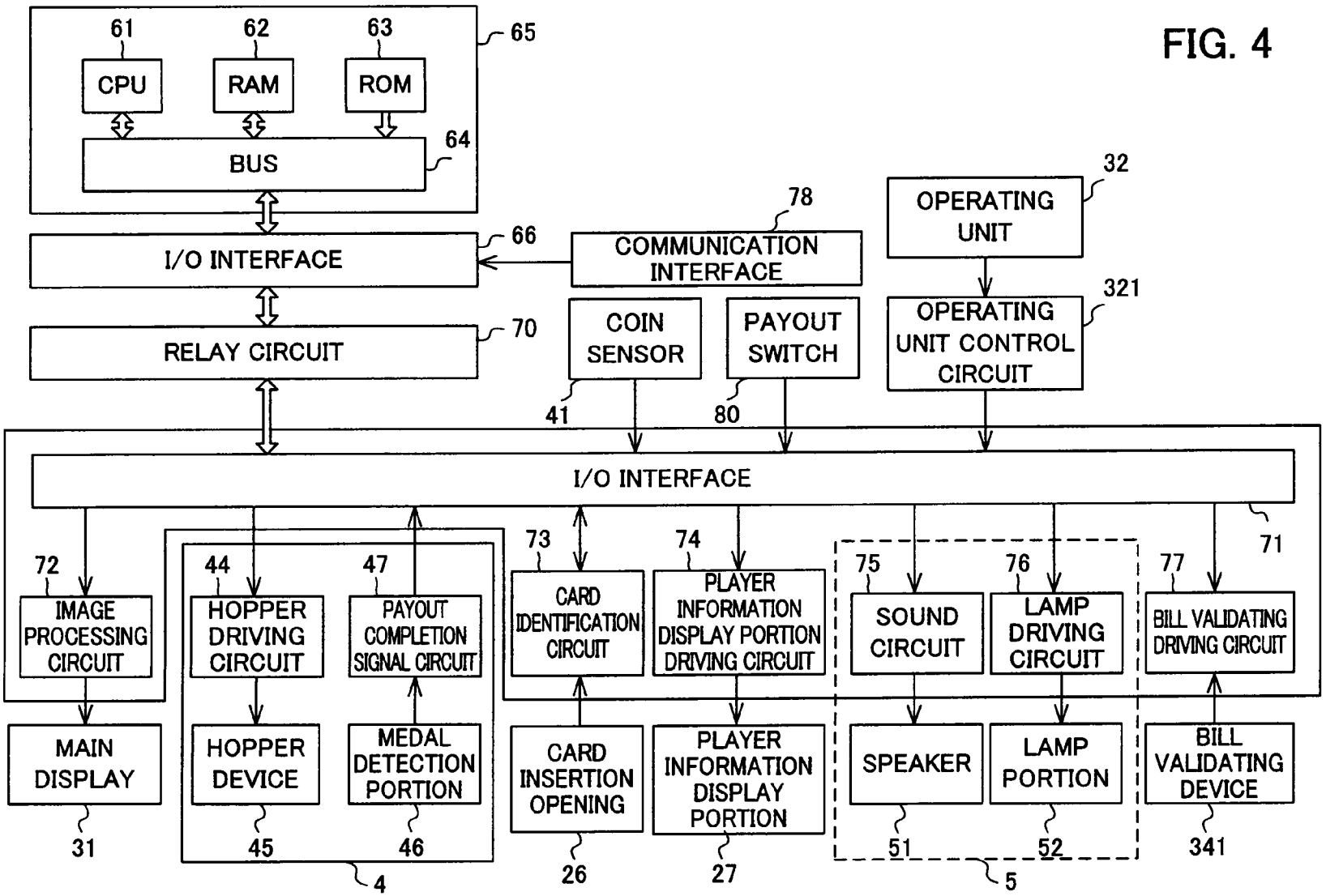
FIG. 4 is a functional block diagram of the gaming machine according to the embodiment of the present invention.

FIG. 4 is a functional block diagram of the gaming machine 1.

The gaming machine 1 according to the present embodiment is basically configured around a microcomputer 65, which is composed of a CPU 61, RAM 62, ROM 63, and a bus 64 for transferring data therebetween. The RAM 62 and the ROM 63 are connected to the CPU 61 via the bus 64. The RAM 52 is memory for temporarily storing various data computed by the CPU 61. The ROM 63 stores various programs, data tables and the like for performing processing required for controlling the gaming machine 1.

The main control unit 221 including the microcomputer 65 is housed by the main housing portion 22 in the cabinet 2.

A communication interface 78 and a relay circuit 70 are connected to the microcomputer 65 via an I/O interface 66. The communication interface 78 is a module for connecting an external network. For example, in a case where a plurality of gaming machines 1 is administered by a server, the gaming machines 1 can communicate with each other and with the server in a bidirectional manner, via the communication interface 78. This allows the gaming machine 1 to execute games in cooperation with the server and other gaming machines 1.

The relay circuit 70 is a circuit for connecting driving circuits and devices (described later) with the microcomputer 65. The relay board unit 211 including the relay circuit 70 is housed by the sub housing portion 21 of the cabinet 2.

The sub housing portion 21 is disposed on an uppermost side T of the cabinet 2, and in a position readily accessible by opening the top door 3. In the present embodiment, only the relay board unit 211 including the relay circuit 70, not the main control unit 221 including the microcomputer 65, is disposed in the sub housing portion 21. In other words, the relay circuit 70, which only relays control signals, is disposed in the most accessible position inside the cabinet 2, and modules (described later) are connected to the microcomputer 65 via the relay circuit 70.

The relay circuit 70 and each of the other modules (described later) are further connected by the I/O interface 71. The modules connected to the microcomputer 65 via the relay circuit 70 are described hereinafter.

An image processing circuit 72 is connected to the relay circuit 70 via the I/O interface 71. The image processing circuit 72 is connected to the main display 31 and controls operation of the main display 31.

The image processing circuit 72 includes program ROM, image ROM, an image control CPU, work RAM, a video display processor (VDP), video RAM, and the like (not shown). The program ROM stores an image control program with respect to the display functions of the main display 31, and various kinds of selection tables. The image ROM stores pixel data for creating an image, for example, pixel data for creating an image on the main display 31. In addition, the image control CPU determines an image to be displayed on the main display 31 from among the pixel data sets stored beforehand in the image ROM according to the image control program stored beforehand in the program ROM based upon the parameters set by the microcomputer 65. The work RAM is configured as a temporary storage means in a case where the image control program is executed by the image control CPU. The VDP is a component for creating an image data that accords with the display contents determined by the image control CPU, and for outputting the image thus created to the main display 31. It should be noted that the video RAM is configured as a temporary storage device used by the VDP for creating an image.

In addition, a hopper unit 4 is connected to the relay circuit 70 via the I/O interface 71. More specifically, connected to the relay circuit 70 are a hopper driving circuit 44 and a payout complete signal circuit 47 in the hopper unit 4. The hopper driving circuit 44 controls operation of a hopper device 45. The payout complete signal circuit 47 manages detection of medals performed by a medal detection portion 46 provided to the hopper device 45, and checks whether medals discharged externally from the hopper device 45 has reached a payout number or not.

A card identification circuit 73 and a player information display portion driving circuit 74 are connected to the relay circuit 70 via the I/O interface 71. The card identification circuit 73 is a reader portion that identifies a player card inserted from the PTS card slot 26 and reads information regarding a player stored on the player card. In addition, a player information display portion 27 is connected to the player information display portion driving circuit 74. Play history information is displayed on the player information display portion 27, from the information regarding a player read by the card identification circuit 73.

A sound circuit 75 is connected to the relay circuit 70 via the I/O interface 71. A speaker 51 is connected to the sound circuit 75. The speaker 51 generates various sound effects, background music and the like when various effects are made, by an output control by the sound circuit 75 based on a driving signal from the CPU 61.

A lamp driving circuit 76 is connected to the relay circuit 70 via the I/O interface 71. Furthermore, a lamp portion (for example, LED) 52 is connected to the lamp driving circuit 76. The lamp portion 52 emits light in a blinking pattern in accordance with an effect, based on a control signal from the microcomputer 65.

It should be noted that, in the present embodiment, the sound circuit 75, the speaker 51, the lamp driving circuit 76, and the lamp portion 52 are configured to be the application unit 5.

A bill validating driving circuit 77 is connected to the relay circuit 70 via the I/O interface 71. A bill validating device 341 is connected to the bill validating driving circuit 77. The bill validating device 341 checks whether or not a bill and a bar coded ticket is genuine. Upon reception of a genuine bill, the bill validating device 341 inputs a value of the bill thus received to the CPU 61, based on an identification signal from the bill validating driving circuit 77. Furthermore, upon reception of a genuine bar coded ticket, the bill validating device 341 inputs a credit amount and the like recorded on the bar coded ticket thus received to the CPU 61, based on an identification signal from the bill validating driving circuit 77.

An operating unit control circuit 320 is connected to the relay circuit 70 via the I/O interface 71. In addition, the operating unit 32 is connected to the operating unit control circuit 320. In the present embodiment, the operating unit 32 is configured to be an exchangeable module. The operating unit 32 can be exchanged accordingly with a module prepared in accordance with a type of a game provided by the gaming machine 1, along with the operating unit control circuit 320.

A coin sensor 41 is connected to the relay circuit 70 via the I/O interface 71. The coin sensor 41 detects a coin, which is inserted via the coin slot 33, passing by.

Cabinet

Figure 5:
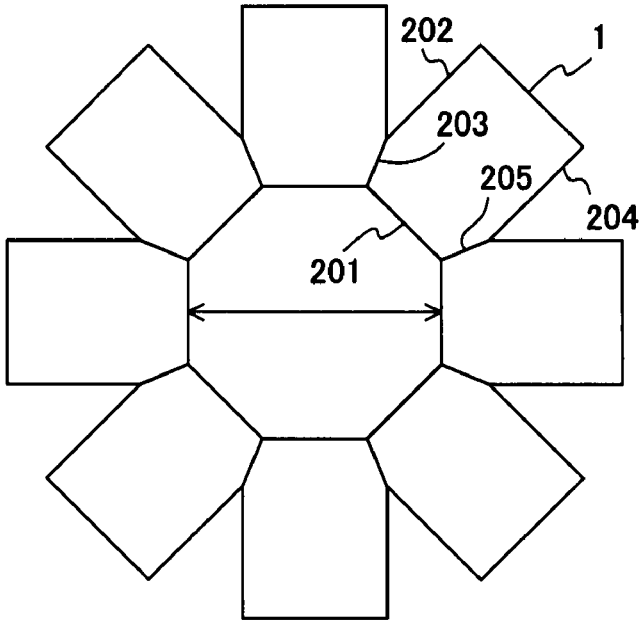
FIG. 5 is a diagram showing a circular arrangement of the gaming machines according to the embodiment of the present invention.
Figure 6:
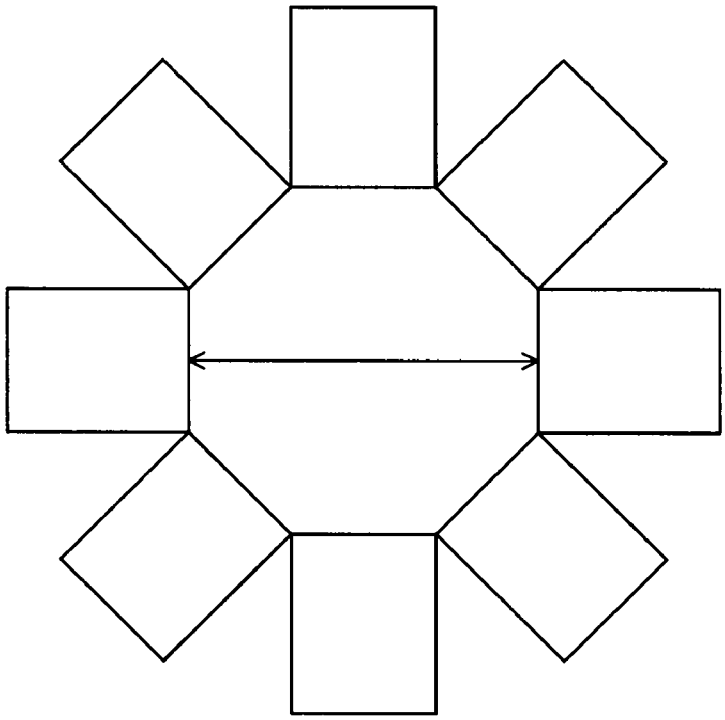
FIG. 6 is a diagram showing a comparative example of FIG. 5.
Figure 7:
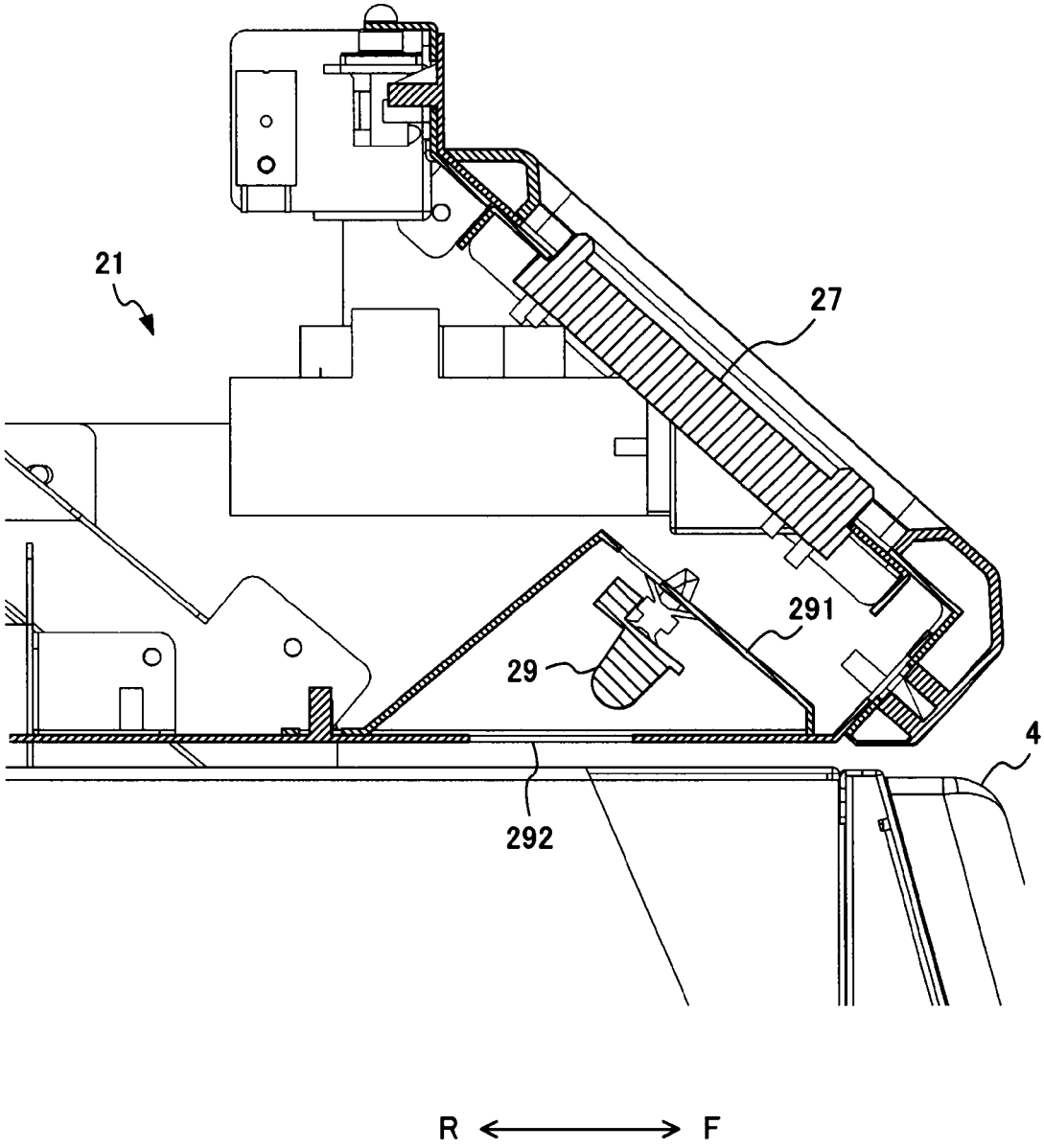
FIG. 7 is a cross-sectional view taken along line A-A in FIG. 2.
Figure 8:
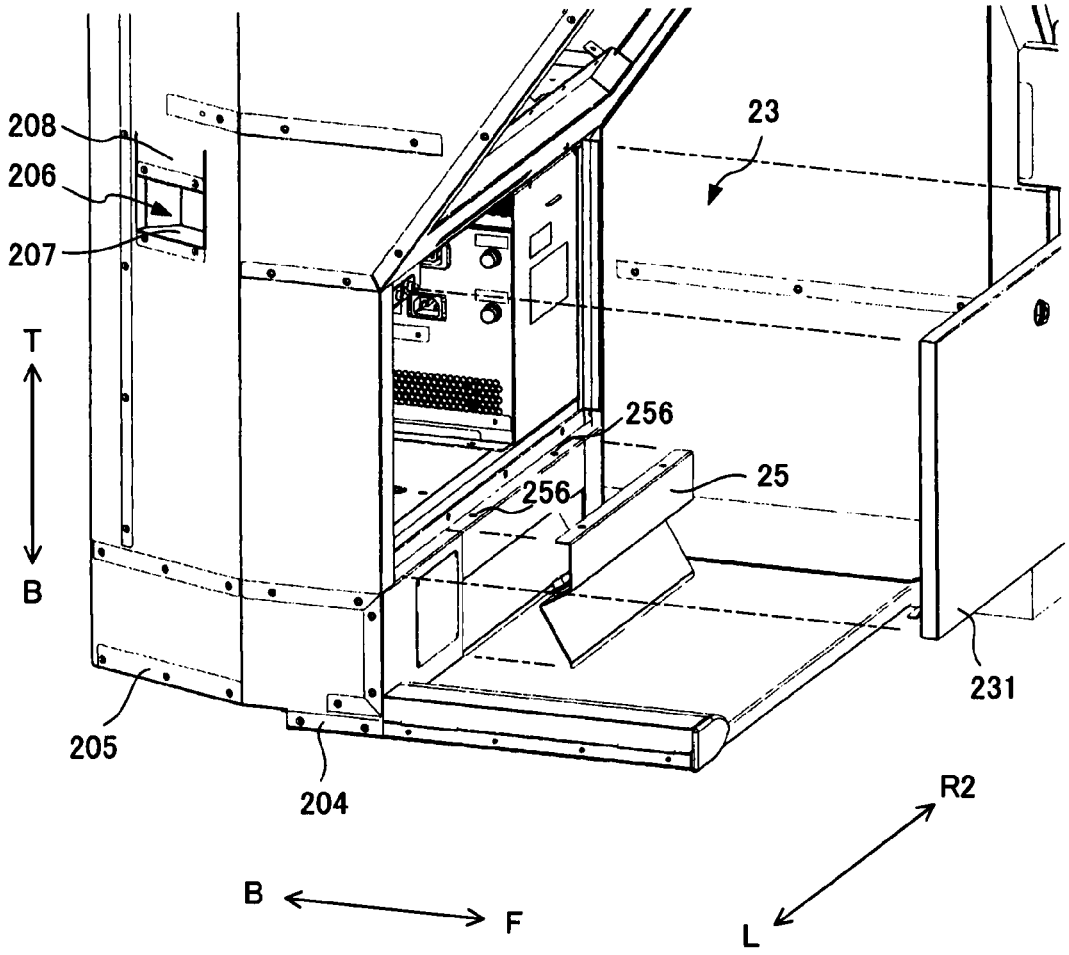
FIG. 8 is an exploded view of the vicinity of a foot lamp according to the embodiment of the present invention.
Figure 9:
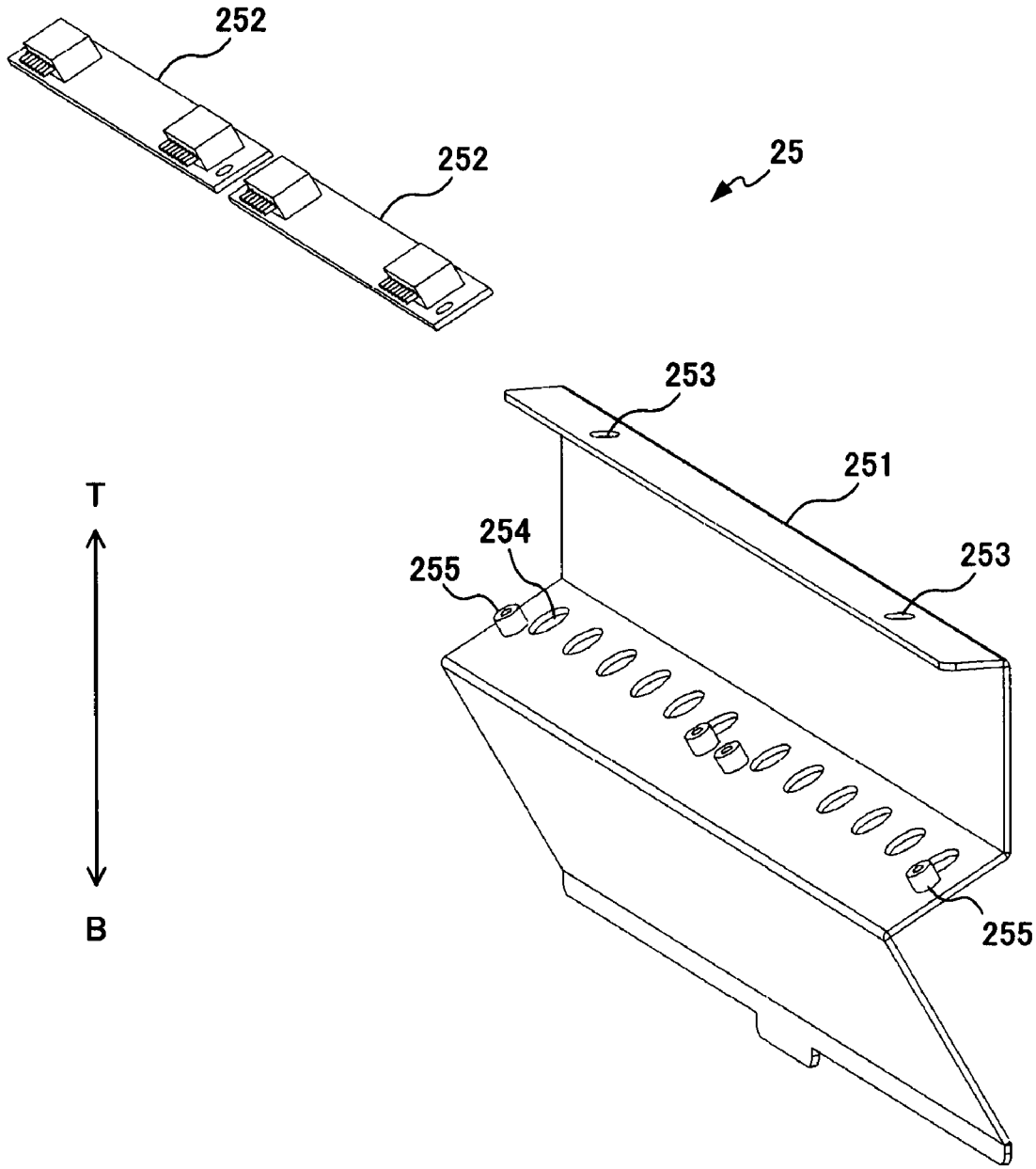
FIG. 9 is an exploded view of the foot lamp according to the embodiment of the present invention.

The cabinet 2 is described in detail hereinafter with reference to FIGS. 1 to 3 and FIGS. 5 to 9. FIG. 5 is a diagram showing a circular arrangement of the gaming machines 1. FIG. 6 is a diagram showing a comparative example of FIG. 5. FIG. 7 is a cross-sectional view taken along line A-A in FIG. 2. FIG. 8 is an enlarged perspective view of the supporting portion 23 and the vicinity of the foot lamp 25. FIG. 9 is an exploded view of the foot lamp 25.

Referring to FIGS. 1, 2 and 5, hereinafter, a lateral face of the cabinet 2 on the right side R2 is referred to as a right lateral face 202, and a lateral face of the cabinet 2 on the left side L is referred to as a left lateral face 204, seen from the front side F of the gaming machine 1. In addition, a face on a rear side (the back side R) of the gaming machine 1 is referred to as a back face 201. A right end face 203 is formed on the right lateral face 202, between an end on the back side R and the back face 201. Similarly, a left end face 205 is formed on the left lateral face 204, between an end on the back side R and the back face 201.

Thus, seen from the upper side T, the gaming machine 1 with the right end face 203 and the left end face 205 has a six-cornered shape, in which a length in the width direction (L-R2 direction) of the front side F (distance between X and X' in FIG. 1) is longer than a length in the width direction (L-R2 direction) of the back face 201 (distance between Y and Y' in FIG. 3).

As used herein, the distance between X and X' is a distance between the right lateral face 202 to the left lateral face 204. In addition, the distance between Y and Y' is a distance from a contact point between the back face 201 and the right end face 203, to a contact point between the back face 201 and the left end face 205.

First, the right end face 203 is a planar surface, which looks like a face made by chamfering a corner horizontally in a direction of gravitational force, connecting two points that are a predetermined distance away from a point of intersection of extended lines of the right lateral face 202 and the back face 201. Similarly, the left end face 205 is a planar surface, which looks like a face made by chamfering a corner horizontally in the direction of gravitational force, connecting two points that are the predetermined distance away from a point of intersection of extended lines of the left lateral face 204 and the back face 201.

In addition, the right end face 203 and the left end face 205 are surfaces between corners of which inner angles with respect to the adjacent lateral face and the back face are at least 90 degrees. More specifically, the right end face 203 is formed to have an inner angle with respect to the right lateral face 202 and an inner angle with respect to the back face 201, which are at least 90 degrees. Similarly, the left end face 205 is formed to have an inner angle with respect to the left lateral face 204 and an inner angle with respect to the back face 201, which are at least 90 degrees.

The present gaming machine 1 is installed in a game hall, for example, in a semicircular or circular arrangement, with the right end face 203 contacting the left end face 205 of an adjacent gaming machine 1, as shown in FIG. 5. This can arrange the gaming machines 1 in a smaller diameter than in a case where substantially rectangular gaming machines, in which the right end face 203 and the left end face 205 are not provided, are installed in a circle (see FIG. 6), thereby saving total installation space.

In addition, a handle portion 206 is provided in each of the right end face 203 and the left end face 205, as shown in FIGS. 1 and 2. The handle portion 206 is a concave portion 207 formed on the faces toward the inside of the cabinet 2. In the concave portion 207, a projecting portion 208 is formed, which is a part of the upper side T that projects so as to cover an opening of the concave portion.

In a case where an administrator moves the gaming machine 1, the administrator can carry the gaming machine by putting their fingers into the concave portion 207 of the handle portion 206 and holding the projecting portion 208 with the fingers bent toward the upper side T.

The handle portion 206 is formed on at least one of the right end face 203 and the left end face 205, preferably on both thereof.

Returning to FIGS. 1 and 2, the cabinet 2 includes the sub housing portion 21 and the main housing portion 22, as described above. The sub housing portion 21 constitutes an upper face of the cabinet 2 and has the opening portion 20 on the upper side T thereof. The top door 3 is disposed so as to cover the opening portion 20. The main housing portion 22 is disposed on the lower side B of the sub housing portion 21 and substantially in a center in a vertical direction (T-B direction) of the cabinet 2. In other words, the sub housing portion 21 is formed between the main housing portion 22 and the top door 3.

In addition, the relay board unit 211 including the relay circuit 70 is housed by the sub housing portion 21 and the main control unit 221 including the microcomputer 65 is housed by the main housing portion 22.

The relay board unit 211 is disposed to be close to the front side when the door 3 is opened. Then, the sub housing portion 21 in which the relay board unit 211 is disposed and the main housing portion 22 in which the main control unit 221 is disposed are divided by a bottom face of the sub housing portion 21, which means that the bottom face of the sub housing portion 21 functions as a division board. The bottom face of this sub housing portion 21 divides the sub housing portion 21 from the main housing portion 22 with the exception of a portion through which a signal line cable that connects the relay circuit 70 with the microcomputer 65 passes. Therefore, with this bottom face, the opening portion 20, the sub housing portion 21, and the main housing portion 22 are disposed so as to be stacked from the upper side T to the lower side B in this order. Accordingly, the relay board unit 211, including the relay circuit 70, and the main control unit 221, including the microcomputer 65 as a main control portion, are also disposed so as to be stacked from the upper side T to the lower side B in this order.

The relay circuit 70 of the relay board unit 211 and the microcomputer 65 of the main control unit 221 are connected to each other via a predetermined signal line cable, and it is preferable that the signal line cable is disposed at a location that cannot be visually recognized when the top door 3 is opened.

Herewith, even in a case where the top door 3 is opened, only the relay board unit 211 can be visually recognized immediately and accessible. In addition, the signal line cable that connects the relay circuit 70 of the relay board unit 211 with the microcomputer 65 of the main control unit 221 is disposed at a location that cannot be visually recognized. Moreover, lines of various types of modules including the main display 31 are connected to the relay board unit 211. Accordingly, a configuration can be made so that a person, who has opened the top door 3 with the intention to perform a fraudulent act, is made to mistakenly recognize the relay board unit 211 as the main control portion. That is, the relay board unit 211 can be used as a dummy of the main control unit 221, and therefore fraud by directly accessing the main control unit 221 can be avoided. Furthermore, for example, in a case where a player puts a drink on an arm rest 35 (described later), even if the drink is spilled on the gaming machine 1, foreign articles such as the drink can only enter the sub housing portion 21, and the main control unit 221 will be free from an effect of such foreign articles.

The main housing portion 22 is formed so as to be gradually shorter in length in the thickness direction (hereinafter referred to as the F-R direction), decreasing from the upper side T to the lower side B. The lower side of the main housing portion 22 is the supporting portion 23 that supports the gaming machine 1.

The supporting portion 23 is formed continuously from the main housing portion 22 to have substantially the same length in the F-R direction as that of the lower side B of the main housing portion 22. In other words, starting from the top, the gaming machine 1 has: the top door 3; the sub housing portion 21; the main housing portion 22; and the supporting portion 23. A portion on the front side F of the top door 3 and the sub housing portion 21 are formed to project from the main housing portion 22 toward the front side F. On the other hand, the main housing portion 22 is formed to be shorter in length in the F-R direction, descending from the upper side T to the lower side B. This creates a space on the lower side B of the display, i.e. on the lower side B of the sub housing portion 21. The space is used as a space for accommodating the legs of a player, in a case where a chair is provided in front of a gaming machine 1 and the player sits thereon. Since the player can sit closer to the gaming machine, the installation area for the gaming machine 1, including a space for accommodating the player, can be reduced.

The main control unit 221 including the microcomputer 65 is housed by the main housing portion 22. A main housing portion door 222 is provided on the front side F of the main housing portion 22, which can be open to take out the main control unit 221.

The sub housing portion 21 houses at least: the relay board unit 221 including the relay circuit 20; the bill validating device 341; and the human body detection sensor 29. In addition, the coin sensor 41 is connected to the top door 3 and housed by the sub housing portion 21. Furthermore, on an outer face in the front side F of the sub housing portion 21, the player information displaying portion 27 and the card slot 26, into which the player card is inserted, are provided.

Since the player information displaying portion 27 and the card slot 26 are provided on an outer face of the sub housing portion 21, an area of the top door 3 can be made smaller, thereby making the whole gaming machine 1 smaller. In addition, even in a case where a string is attached to the playing card for carrying thereof, the string will not fall on the main display, whereby it is possible to prevent impairment of visual recognition thereby.

As shown in FIG. 7, the human body detection sensor 29 is disposed on the front side F in the sub housing portion 21. Furthermore, the human body detection sensor 29 is disposed substantially in a center in the width direction (L-R2 direction) of the cabinet 2, i.e. substantially in a center between Z and Z' (distance between Z and Z' in FIG. 1).

As used herein, the distance between Z and Z' is a distance between the left side L of the cover member 38 and a lateral face on the left side L of the hopper unit 4.

The human body detection sensor 29 is disposed inside a sensor housing 291. The sensor housing 291 is formed to have a substantially triangular cross section, and the human body detection sensor 29 is disposed on a tilted surface facing the back side R. Therefore, the human body detection sensor 29 is disposed so that an apex thereof faces the back side R and the lower side B. This configuration allows the player's legs, which enter the space created on the lower side B of the sub housing portion 21, to be detected, whereas players passing in front of the gaming machine 1 will not to be mistakenly detected.

In the present embodiment, an infrared sensor can be used, for example, as the human body detection sensor 29. The infrared sensor is a so-called thermal infrared sensor, and captures a change in temperature of a sensor element due to infrared radiation radiated thereon by a human body and the like, as a change in resistance or a change in a physical phenomenon such as a thermo-electromotive force and a pyroelectric effect, and outputs thereof as an electric signal.

A sensor hole 292 is formed on an extended line from the apex of the human body detection sensor 29. The sensor hole 292 is formed on a surface on the lower side B of the sub housing portion 21. Furthermore, the sensor hole 292 is formed in a center in the width direction (L-R2 direction) of the cabinet 2, i.e. in a center between Z and Z' (distance between Z and Z' in FIG. 2). The human body detection sensor 29 detects infrared radiation generated by a human body through the sensor hole 292.

It should be noted that, in a case where the hopper unit 4 is not provided, the human body detection sensor 29 and the sensor hole 292 can be disposed or formed substantially in a center in the width direction (L-R2 direction) of the cabinet 2.

The foot lamp 25 is described hereinafter with reference to FIGS. 8 and 9.

As shown in FIG. 8, the cabinet 2 further includes the foot lamp 25 on the front side F of the supporting portion 23. Furthermore, the foot lamp 25 is disposed on the lower side B of the supporting portion 23, so that light is emitted toward the lower side B.

As shown in FIG. 9, the foot lamp 25 is composed of a foot lamp cover 251 and an LED substrate 252. Screw holes 253 and 253 are formed on the foot lamp cover 251, through which the foot lamp cover 251 is fixed to the cabinet 2 with screws. The screw holes 253 and 253 are formed in positions corresponding to positions of screw holes 256 and 256 formed in the front side F of the supporting portion 23. In a case where the foot lamp 25 is attached to the supporting portion 23 and a supporting portion door 231 is closed, the screw holes 253 and 253 are hidden behind the supporting portion door 231.

Light transmitting holes 254 are formed on the foot lamp cover 251, through which light from an LED provided on the LED substrate 252 transmits. The LED substrate 252 is disposed so as to align with the light transmitting holes 254, and mounted with screws to the foot lamp cover 251 by way of mounting bosses 255.

The foot lamp 25 lights the vicinity of the feet of a player sitting on a chair in front of the gaming machine 1. On the other hand, when a player is seated, the foot lamp 25 is hidden behind the player and the light thereof is not perceivable from other players passing by the gaming machine 1. Therefore, a player looking for a vacant gaming machine can find the gaming machine 1 with the light on the lower side B. Furthermore, in the present embodiment, the foot lamp 25 is controlled to be turned off when a player is seated at the front side F of the gaming machine 1. Details are described later.

In addition, as shown in FIG. 3, the cabinet illuminating portion 24 is provided on the back side R of the cabinet 2. The cabinet illuminating portion 24 emits light or switches between modes of illumination in accordance with operation on the operating unit 32 by a player. Change in the cabinet illuminating portion 24 is described later in detail.

Top Door

Figure 10:
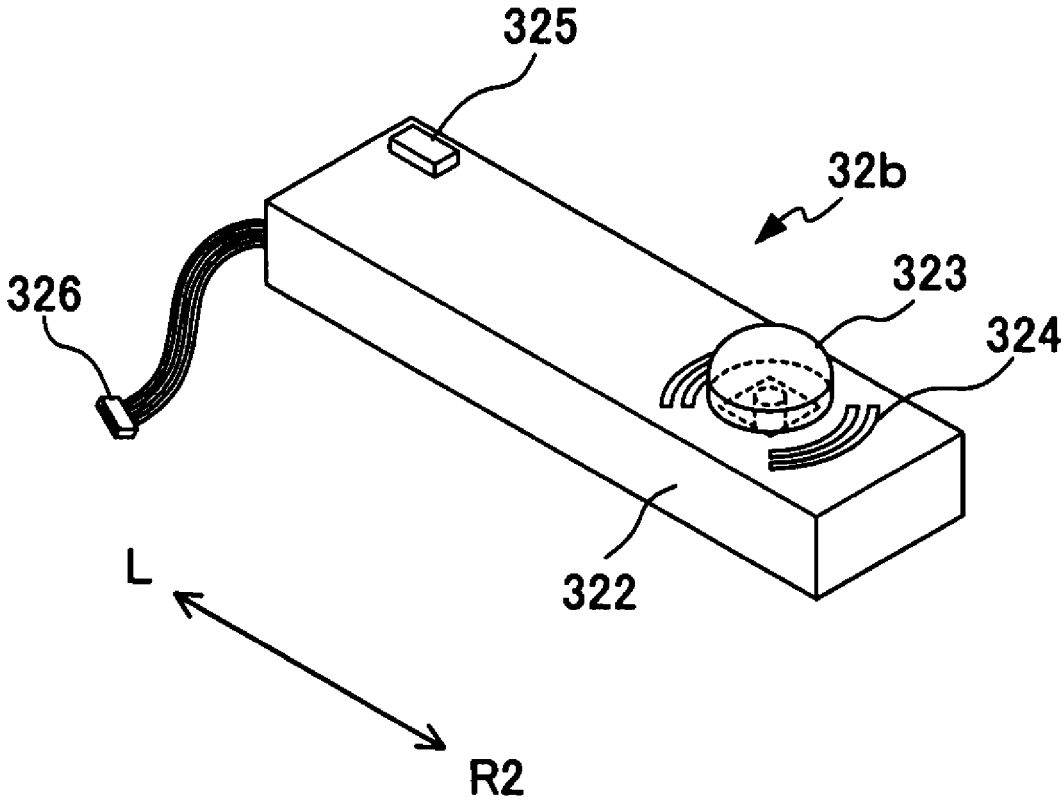
FIG. 10 is an enlarged view of an operating unit according to the embodiment of the present invention.
Figure 11:
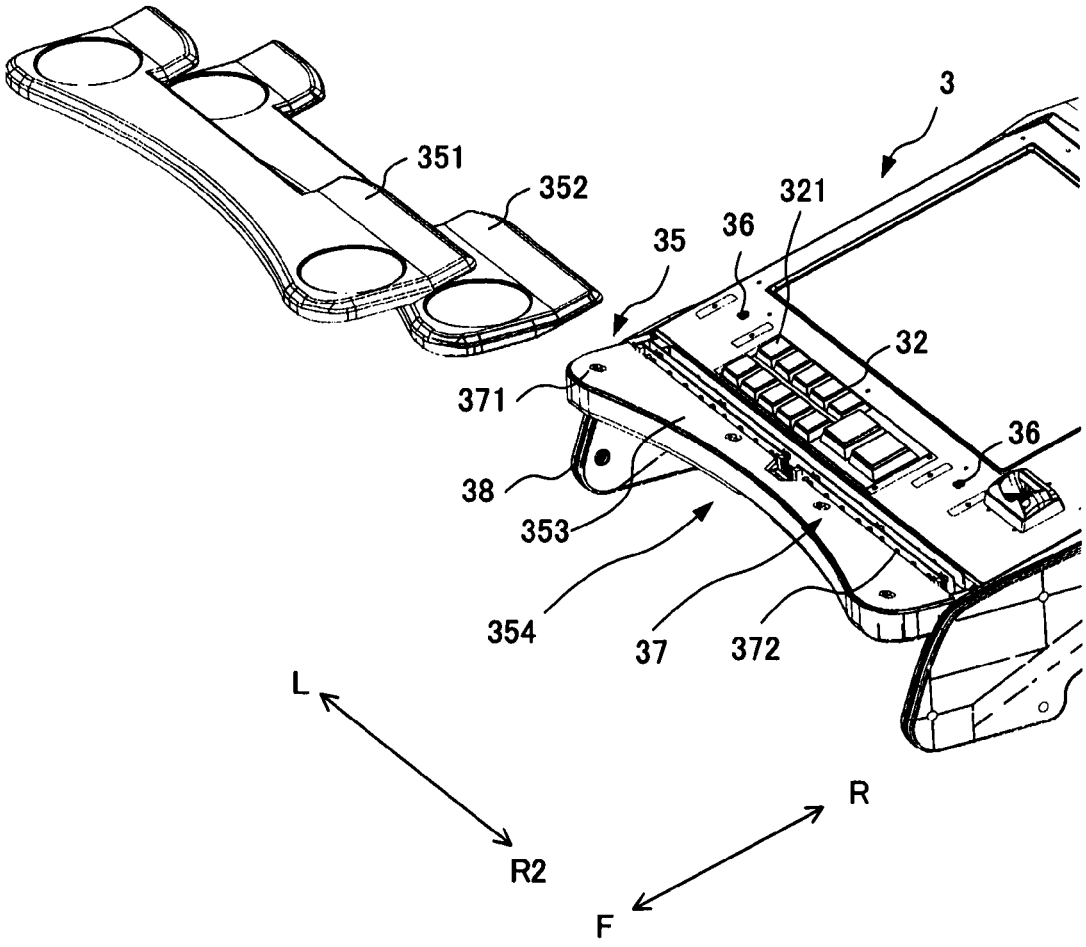
FIG. 11 is an enlarged exploded view of the top door, in the vicinity of an arm rest, according to the embodiment of the present invention.
Figure 12:
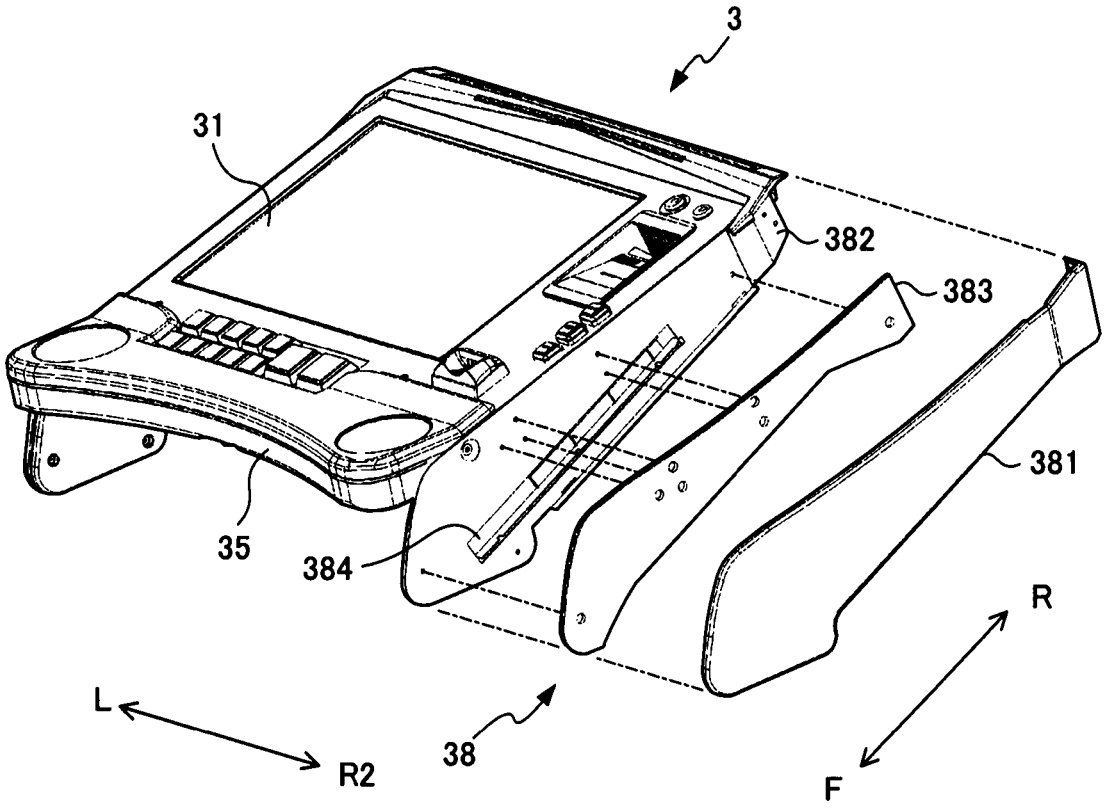
FIG. 12 is an enlarged exploded view of the top door, in the vicinity of a cover member, according to the embodiment of the present invention.

The top door 3 is described in detail hereinafter with reference to FIGS. 1, 2, 10, and 11. FIG. 10 is an enlarged view of an operating unit 32*b*. FIG. 11 is an enlarged exploded view of the top door 3, in the vicinity of an arm rest 35. FIG. 12 is an enlarged exploded view of the top door 3, in the vicinity of a cover member 38.

As shown in FIG. 1, the top door 3 is disposed so as to cover the upper face of the cabinet 2, in a state of being tilted toward the front side F that is a front face of the gaming machine 1. In addition, the operating unit 32, the coin slot 33, the bill slot 34, and the arm rest 35 are disposed on the top door 3. On a reverse side of the top door 3, the coin sensor 41 is disposed in a position corresponding to the coin slot 33. In other words, the top door is provided with various devices such as devices that operate based on a signal from the control unit and devices that transmit a signal to the control unit. The devices are all connected to the main control unit 221 including the microcomputer 65, via the relay board unit 221 (the relay circuit 70) that is a relay portion.

The main display 31 is disposed on the upper side T of the top door 3 and occupies a majority of a surface thereof. In addition, since the top door 3 is disposed in the state of being tilted toward the front side F of the cabinet 2, the main display 31, which is disposed on the upper side T of the top door 3, is also disposed in the state of being tilted toward the front side F that is the front face of the gaming machine 1. The main display 31 displays images associated with the games. The main display 31 is preferably formed to have an aspect ratio at which a length in the horizontal direction (the L-R2 direction in the present embodiment) is greater than a length in the vertical direction (the F-R direction in the present embodiment). In other words, a so-called wide display that is long in the longitudinal direction thereof, which is a width direction (L-R2 direction) of the gaming machine 1, is preferable.

The operating unit 32 is disposed to be adjacent to the main display 31. In the present embodiment, the operating unit 32 is disposed on the front side F of the main display 31. A player performs operations necessary for the games executed by the gaming machine 1 via the operating unit 32. The operating unit 32 shown in FIGS. 1 and 2 has a plurality of keys 321, to which functions for the games executed by the gaming machine 1 are assigned.

Furthermore, the operating unit 32 is configured as a single module, which is exchangeable in accordance with the games executed by the gaming machine 1. An example of the operating unit 32 is an operating unit 32*b* shown in FIG. 10.

The operating unit 32*b* is an operating unit for the gaming machine 1 executing a dice game called Sic Bo. The operating unit 32*b* for Sic Bo is provided with a roll button 323 for rolling dice, a notification lamp disposed so as to enclose the roll button 323, and a bet button 325 for making a bet, on the right side R2 of an operating unit main body 322. In addition, the operating unit 32*b* is connected to the relay board unit 211 of the gaming machine 1 by means of a connector 326.

The roll button 323 is operated in a Sic Bo game for shuffling dice after making a bet on the number of spots and a combination of spots on the rolled dice as a random number generator (in other words, after generating random numbers). Shuffle of the dice can be performed using virtual dice displayed on the main display 31 or using real dice by means of a dice unit (not shown) provided besides the gaming machine 1. As used herein, the dice unit includes a plurality of dice and a device for rolling dice.

The notification lamp 324 notifies that a player can roll the dice by operating the roll button 323. More specifically, the notification lamp 324 lights when a player can start rolling the dice after making a bet. In addition, in a case where a game is executed in coordination with the dice unit and a plurality of gaming machines 1, after that bets are made by the plurality of gaming machines 1, a player having a right to roll the dice is selected by a dealer or a server managing the game. Thereafter, when the player can start rolling the dice, only the notification lamp 324 on the gaming machine 1 operated by the selected player lights. A flow of the processing is described later.

Returning to FIG. 1, a sound sensor 36 is provided on both sides of the operating unit 32. The sound sensor 36 recognizes the voice of a player. The sound sensor 36 is connected to the microcomputer 65 via the relay circuit 70 in the relay board unit 211. The sound sensor 36 is disposed below a plurality of small holes formed on a surface of the top door 3.

In addition, an arm rest 35 is provided on the front side F of the operating unit 32. The arm rest 35 is a projecting portion provided so as to project toward the front side F of the cabinet 2 with the top door 3 being closed, and an end portion thereof on the front side F is an end portion on the front side F of the top door 3. The end portion thereof has a concave portion 354 that is slightly hollow toward the main display 31 and centered substantially at a center in the width direction (L-R2 direction).

The player information display portion 27, which is provided on the lower side B of the concave portion 354 formed on the arm rest 35, allows a player to visually recognize a display content of the player information display portion 27 by inhibiting the arm rest 35 from blocking the player's view.

The arm rest 35 includes an arm rest illuminating portion 37. Light from the arm rest illuminating portion 37 can be visually recognized from a side of an end on the front side F of the arm rest 35.

Referring to FIG. 11, the arm rest 35 is composed of arm rest covers 351 and 352 constituting a surface of the arm rest 35 and an arm rest base 353 constituting a face on the lower side B of the arm rest 35. In addition, the arm rest illuminating portion 37 is disposed between the arm rest covers 351 and 352 and the arm rest base 353.

The arm rest illuminating portion 37 is composed of a light guiding plate 371 and an LED 372. The LED 372 is disposed along a face of the arm rest base 353 to the side of the operating unit 32, so that light therefrom is directed toward the front face F.

The light guiding plate 371 is formed in a plate-like shape and disposed so as to cover an entire face of the arm rest base 353 on the upper side T. In addition, the light guiding plate 371 is disposed on the front side F of the LED 372 so that an end face thereof faces the LED 372. Then, the light guiding plate 371 surface-emits light, by dispersing point-like light of the LED 372, introduced from the end face thereof, to the entire light guiding plate 371.

The arm rest covers 351 and 352 are disposed on the upper side T of the light guiding plate 371. The light guiding plate is disposed between the arm rest covers 351 and 352 and the arm rest base 353, and only an end face thereof is visually recognizable. When viewed from the front side F of the gaming machine 1, light from the arm rest illuminating portion 37 can be visually recognized in a linear shape on a side to the front side F of the arm rest 35.

Referring to FIGS. 1, 2 and 12, a cover member 38 is provided on each side in the width direction (L-R2 direction) of the top door 3. In the present embodiment, the cover member 38 is provided so as to cover an entirety of each side in the width direction (L-R2 direction) of the top door 3 (see FIGS. 1 and 2). The cover member 38 is formed so that a shape of a lower end thereof follows a shape of the opening portion 20 of the cabinet 2 when the top door 3 is closed. In addition, the cover member 38 is formed so as to become gradually longer in the vertical direction (T-B direction) from the back side R to the front side F. The front side F of the cover member 38 is formed so as to cover a side of a portion in the sub housing portion 21 of the cabinet 2, in which the player information display portion 27 and the card slot 26 are disposed.

As shown in FIG. 12, the cover member 38 has a three-layered structure including an outer cover 381 disposed on an outermost side, an inner cover 382 disposed on an inner side, and an intermediate cover 383 disposed between the outer cover 381 and the inner cover 382. The intermediate cover 383 is disposed so as to mainly cover an upper side T half of the inner cover 382. An LED portion 384 is disposed on the lower side B of the intermediate cover 383, between the outer cover 381 and the inner cover 382.

The outer cover 381 and the inner cover 382 are members having sufficient stiffness to reinforce the top door 3, and can be formed of the same member or different members. The intermediate cover 383 is disposed on the upper side T of the LED portion 384, around the LED portion. The outer cover 381, disposed to cover the LED portion 384, is preferably made of a member through which light from the LED portion 384 can be visually recognized, such as a translucent member and a transparent member.

The LED portion is connected to the relay circuit 70 of the relay board unit 211. In addition, the LED portion 384 is connected to the microcomputer of the main control unit via the relay board unit 221. The LED portion 384 has various illuminating modes such as lighting-up, blinking, switching off, and the like, in accordance with a control signal from the CPU 61, as one rendered effect for games executed by the gaming machine 1.

It should be noted that, although FIG. 12 shows an exploded view of the cover member 38 on the right side R2, the cover member 38 on the left L is similarly configured.

Returning to FIGS. 1 and 2, an uneven portion 28 is formed on an end on the upper side T of the right lateral face 202, the right end face 203, the left lateral face 204, and the left end face 205 of the cabinet 2. The uneven portion 28 includes: a bottom portion 281 that is formed to be substantially horizontal to the bottom face of the cover member 38 in a case where the top door 3 is closed, and a wall portion 282 formed in the vertical direction from the bottom portion 281 toward the upper side T on an end, toward the inside of the cabinet 2, of the bottom portion 281 (see FIG. 2).

The length in the width direction (L-R2 direction) of the bottom portion 281 is at least a length of thickness of the cover member 38. In addition, the length preferably has substantially the same length as that of the length of thickness of the cover member 38.

When the top door 3 is in a state of being closed, the cover member 38 is in contact with the bottom portion 281 of the uneven portion 28 (see FIG. 1). Furthermore, the right lateral face 202, the right end face 203, the left lateral face 204 and the left end face 205 are each connected with the cover member 38, thereby forming the lateral face of the cabinet 2.

By disposing the cover member 38, the top door 3 can be reinforced. In addition, in a case where the top door 3 is closed, since the cover member 38 contacts the bottom portion 281 of the uneven portion 28 formed on a side to the cabinet 2 and the right lateral face 202, the right end face 203, the left lateral face 204 and the left end face 205 are each connected with the cover member 38 and form the lateral face of the cabinet 2, and although a player having malicious intent may try to force the top door 3 open, a handhold can be eliminated, thereby preventing tampering.

Furthermore, since the uneven portion 28 has a wall portion 282 that is formed in a vertical direction from the bottom portion 281, in a case where the top door 3 is closed and the cover member 38 and the bottom portion 281 are contacting each other, even if a crowbar or the like is inserted therebetween, the wall portion 282 can block the crowbar. Particularly in the present embodiment, since the width of the bottom portion 281 is substantially the same as the thickness of the cover portion 38, even if a crowbar or the like is inserted between the cover member 38 and the bottom portion 281, the crowbar would immediately abut into the wall portion 282 and would not be able to get a supporting point, thereby preventing the top door 3 from being forced open.

Figure 13:
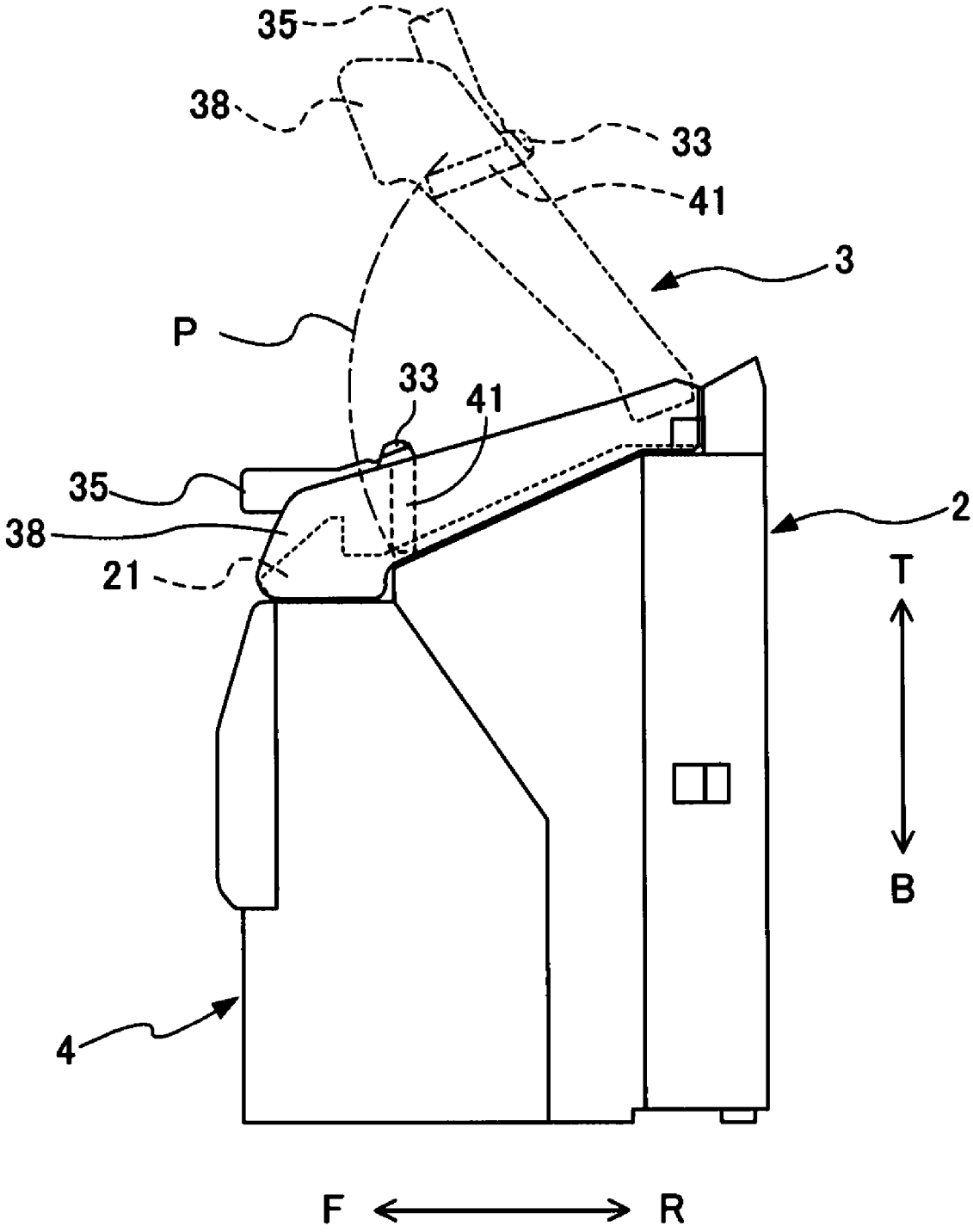
FIG. 13 is a diagram showing a relationship between a coin sensor and a sub housing portion of the cabinet in a case where the top door is opened and closed, according to the embodiment of the present invention.
Figure 14:
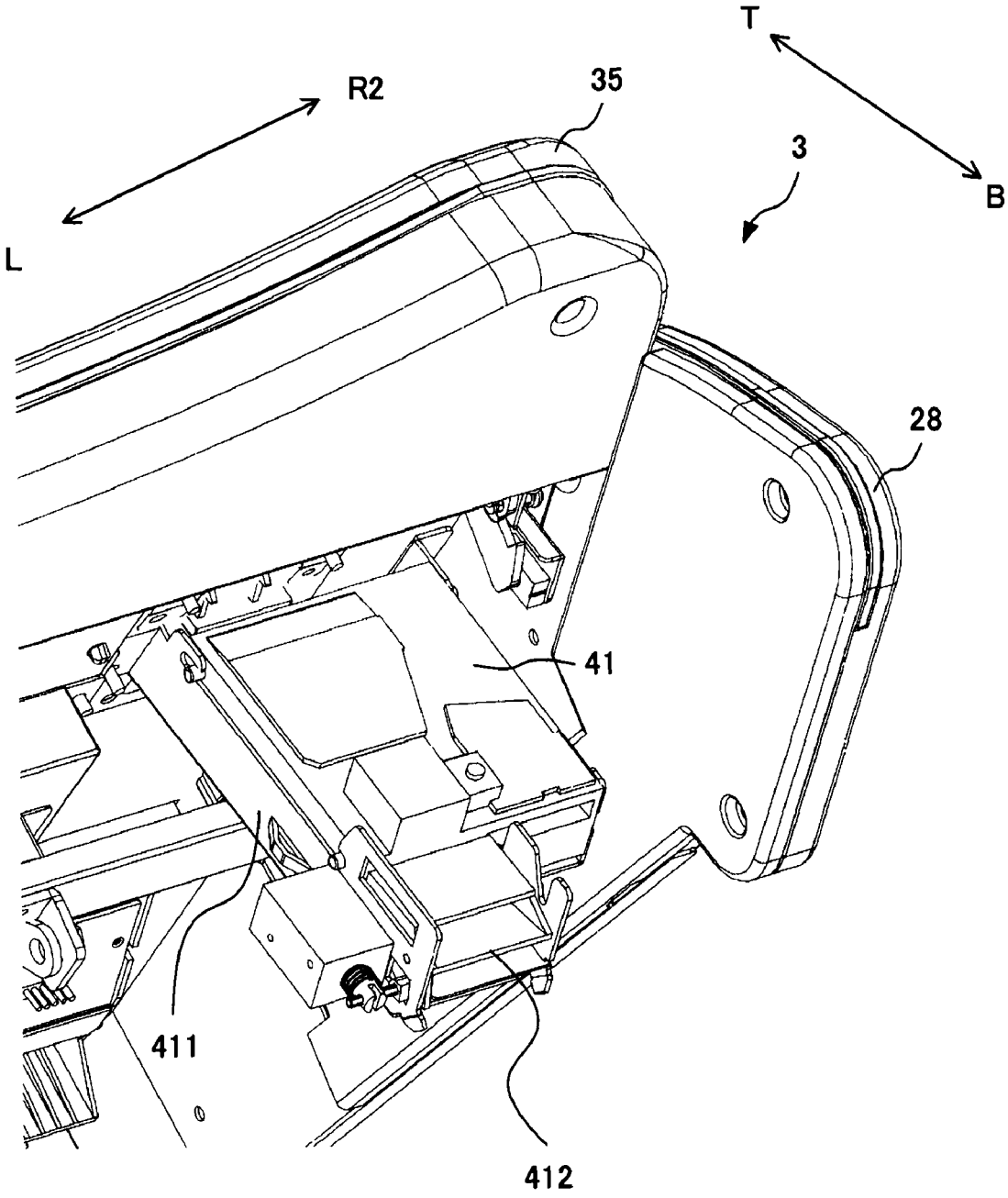
FIG. 14 is a partial enlarged view of the vicinity of a coin sensor according to an embodiment of the present invention.
Figure 15:
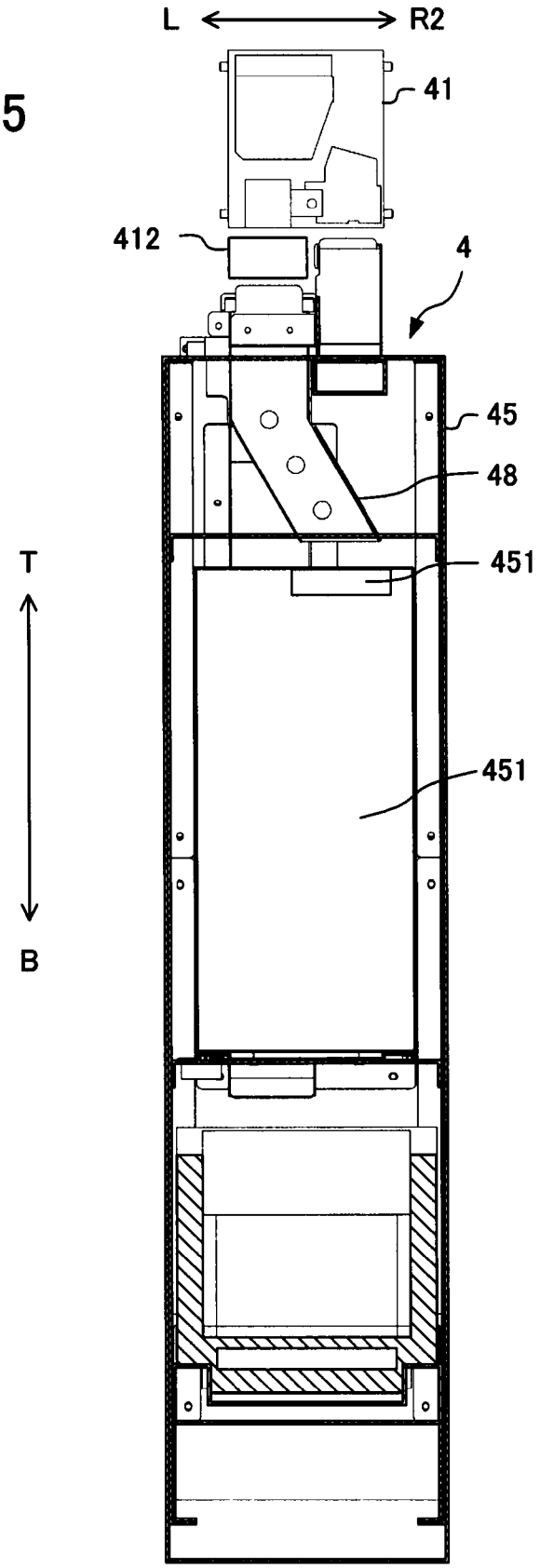
FIG. 15 is a cross-sectional view of a hopper unit according to the embodiment of the present invention.

The hopper unit 4 and the coin sensor 41 are described hereinafter with reference to FIGS. 13 to 15. FIG. 13 is a diagram showing a relationship between a coin sensor 41 and a sub housing portion 21 of the cabinet 2 in a case where the top door 3 is opened and closed. FIG. 14 is a partial enlarged view of the vicinity of a coin sensor 41. FIG. 15 is a cross-sectional view of a hopper unit 4.

According to FIG. 1, the coin slot 33 is formed on the upper side T of the top door 3. In addition, the coin slot 33 is disposed more to the front side F than a center in the thickness direction (F-R direction) of the top door 3, and more to the back side R than an end on the front side F of the top door 3. More particularly, the coin slot 33 is disposed on a face of the cabinet 2 where the player information display portion 27 is disposed, more to the back side R than an end on the upper side T.

As shown in FIG. 13, the coin sensor 41 is disposed on a lower side B (reverse side) of the top door 3. In addition, the coin sensor 41 is disposed directly below (on the lower side B of) the coin slot 33. More particularly, as shown in FIG. 14, the coin slot 33 is disposed so that the coin sensor 41, which is disposed directly below the coin slot 33, does not interfere with an upper end (an end on the upper side T) on the front side F of the cabinet 2 when the top door 3 is opened and closed.

More specifically, the coin slot 33 is disposed so that a trajectory P of an end on the lower side B of the coin sensor 41, which is disposed on the reverse side of the top door 3, does not interfere with the sub housing portion 21 of the cabinet 2, when the top door 3 is opened by lifting an end thereof on the front side F and swinging the top door 3 open with an end thereof on the back side R as a rotational axis. In other words, the end on the lower side B of the coin sensor 41 follows a circular path around the end on the back side R of the top door 3, and the coin sensor 41 is disposed so that the end on the upper side T of the cabinet 2 is positioned outside the circular path. In the present embodiment, the end on the upper side T of the cabinet 2 is the front side F of the opening portion 20 of the sub housing portion 21.

As a result, in a case where the coin slot 33 is disposed on an end on the front side F of the top door 3, the coin sensor 41 may interfere with the cabinet 2; however, as described above, the coin slot is disposed more to the back side R than the end on the upper side T, thereby preventing interference.

As shown in FIG. 14, the coin sensor 41 is fixed on the top door 3 by a sensor case 411, at a position corresponding to the coin slot 33 on a lower side B (reverse side) of the top door 3. In other words, the coin sensor 41 is provided so as to connect with the coin slot 33. In addition, on an end on the lower side B of the coin sensor 41, a connection opening 412 is provided for connecting with a guidepath 48 that guides coins having passed through the coin sensor 41 into the hopper unit 4.

Since the coin sensor 41 is provided in the vicinity of the coin slot 33, on the reverse side of the top door 3, there is no need to provide a guidepath between the coin slot 33 and the coin sensor 41. As a result, the jamming of coins between the coin slot 33 and the coin sensor 41 is eliminated.

FIG. 15 is a cross-sectional view of a hopper unit 4, showing a positional relationship thereof with respect to the coin sensor 41. The hopper unit 4 is disposed on a straight line that extends from the coin sensor 41 in a direction of gravitational force. In addition, the guidepath 48 to the hopper unit 4 is disposed directly below the connection opening 412, which is the lower end side of the coin sensor 41.

The guidepath 48 is disposed directly below the connection opening 412 of the coin sensor 41, i.e. on a straight line that extends from the coin slot 33 in the direction of gravitational force. Furthermore, the guidepath 48 is formed in a shape of a straight line or a polygonal line and connected with a coin tank 451 in the hopper device 45. The coin tank 451 retains coins inserted from the coin slot 33 and having passed through the coin sensor 41 and the guidepath 48.

As described above, the guide path 48 being formed in a form of a straight line can prevent the coins from being jammed in the guide path 48.

A length in the width direction (L-R2 direction) of the hopper unit 4 preferably corresponds to a size of the main display 31. In other words, the main display 31 is formed to have an aspect ratio greater than 4 to 3. Accordingly, the length in the width direction (L-R2 direction) of the hopper unit 4 is preferably formed in accordance with an increase in size of the main display 31, from a case of an aspect ratio of 4 to 3. In the present embodiment, the main display 31 has an aspect ratio of 16:9, and is longer in the width direction (L-R2 direction) than in a case of an aspect ratio of 4 to 3. In addition, the length in the width direction (L-R2 direction) of the hopper unit 4 is determined in accordance with a growth in length in the width direction (L-R2 direction) of the main display 31. It should be noted that, although the hopper unit 4 is thinner than a conventional hopper unit, a size thereof in the thickness direction (F-R direction) reaches the front side F of the cabinet 2 as shown in FIGS. 1 and 2, and thus an amount of retained coins therein is the same as a conventional hopper unit.

Figure 16:
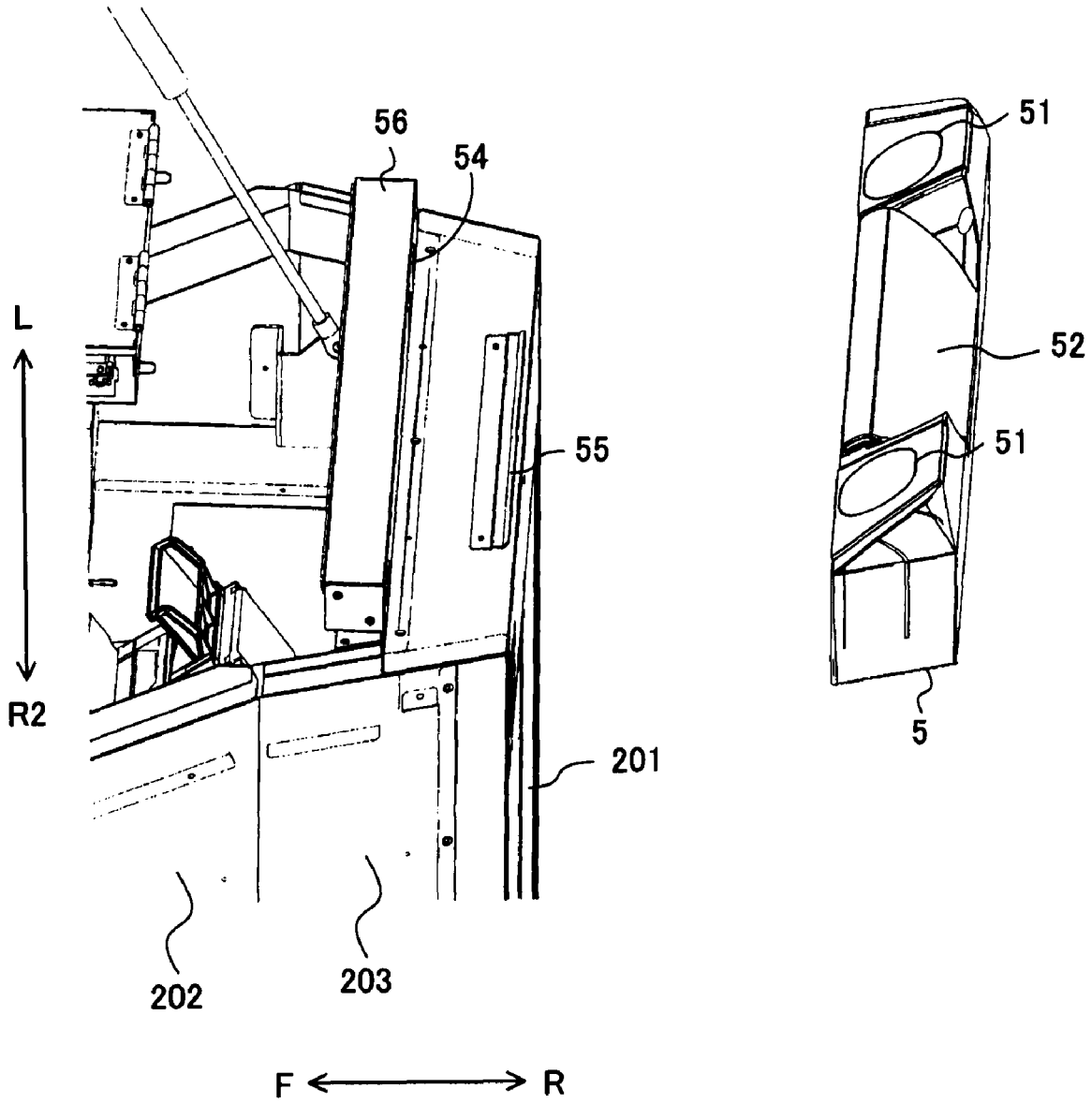
FIG. 16 is an enlarged exploded view of the vicinity of an application unit disposed on a back face side R of the cabinet according to the embodiment of the present invention.

The application unit 5 is described hereinafter with reference to FIG. 16. FIG. 16 is an enlarged exploded view of the vicinity of an application unit 5 disposed on a back face side R of the cabinet 2.

In the present embodiment, the application unit 5 is disposed on the back side R of the cabinet 2. The application unit 5 is formed to be attachable/detachable with respect to the cabinet 2 by means of a screw or the like (not shown), in consideration of maintainability, and connected to the relay board unit 211 of the cabinet 2 by means of a connector (not shown) extended from the application unit 5, via a connection hole 54 formed on the cabinet 2.

In addition, the application unit 5 is disposed on the upper side T of the cabinet 2. Furthermore, the application unit 5 is disposed in an end portion on the back side R on the upper face of the cabinet 2, along the width direction (L-R2 direction). The application unit 5 is set between a supportive plate 55 provided in the end portion on the back side R of the cabinet 2 and a supportive projection 56 provided so as to face the supportive plate 55. It should be noted that the supportive plate 55 and the supportive projection 56 are both formed to be horizontally long along the width direction (L-R2 direction) of the cabinet 2, and a length of a gap between the supportive plate 55 and the supportive projection 56 preferably corresponds to a length of the application unit 5 in the thickness direction (F-R direction).

The connector, as a connection portion for connecting a cable extending from the application unit 5, is preferably provided to the connection hole 54. This facilitates replacement of the application unit 5.

The application unit 5 is formed to be horizontally long along the width direction (L-R2 direction) of the cabinet 2, and includes the speaker 51 and the lamp portion 52 in the present embodiment. The speaker 51 is provided on both ends of the application unit 5, and the lamp portion 52 is provided between the two speakers 51. The speaker 51 and the lamp portion 52 emit sound or light in response to a control signal from the microcomputer 65.

It should be noted that, in addition to the speaker 51 and the lamp portion 52, various devices can be installed on the application unit 5. For example, a sub display that is different from the main display 31 can be installed thereon in order to execute a game on two windows or to display information regarding a game on the sub display on the application unit 5. In addition, coloring of the application unit 5 can be changed in accordance with the design of a casino hall and the like.

Control Flow

Figure 17:
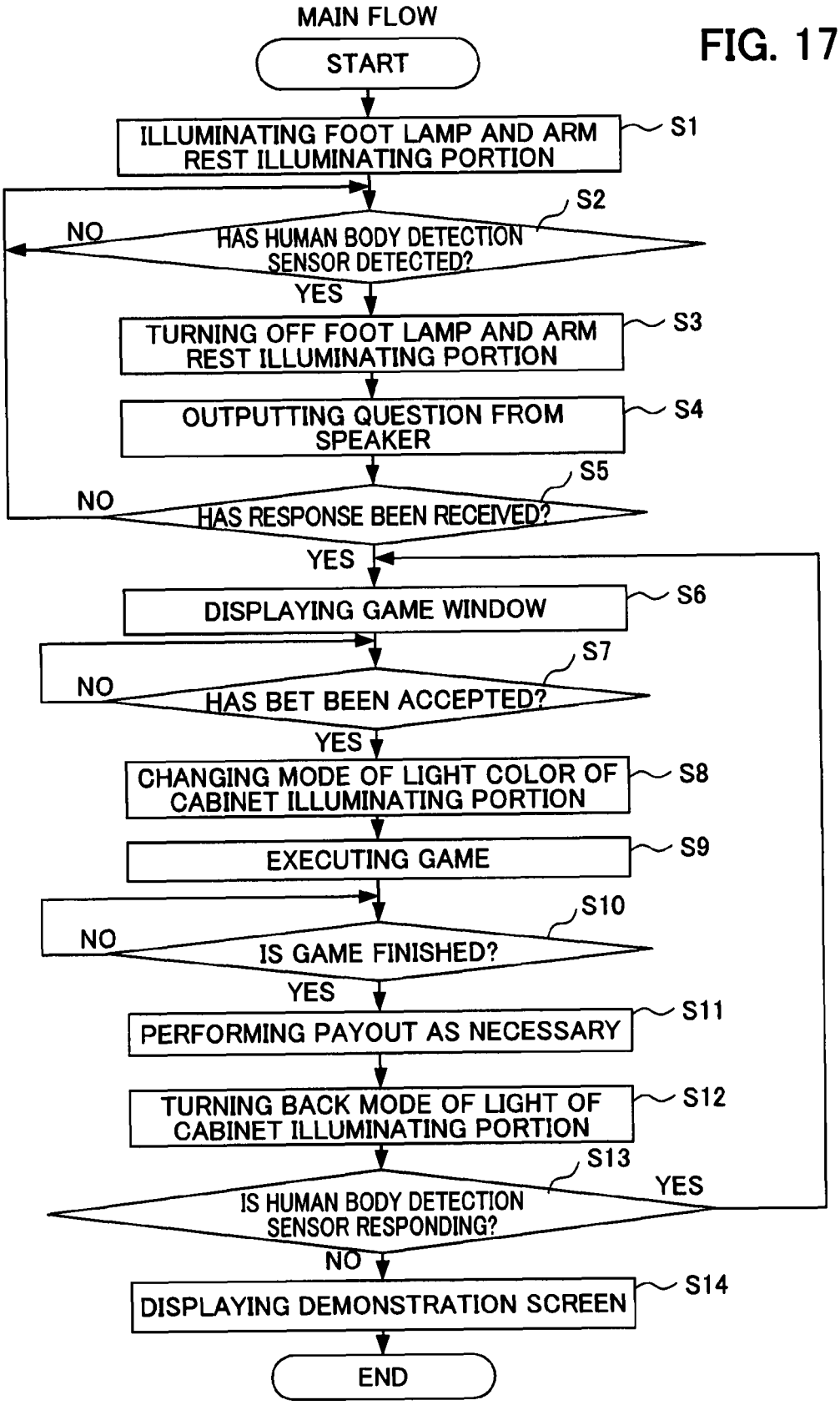
FIG. 17 is a diagram showing a main flow according to the embodiment of the present invention.
Figure 18:
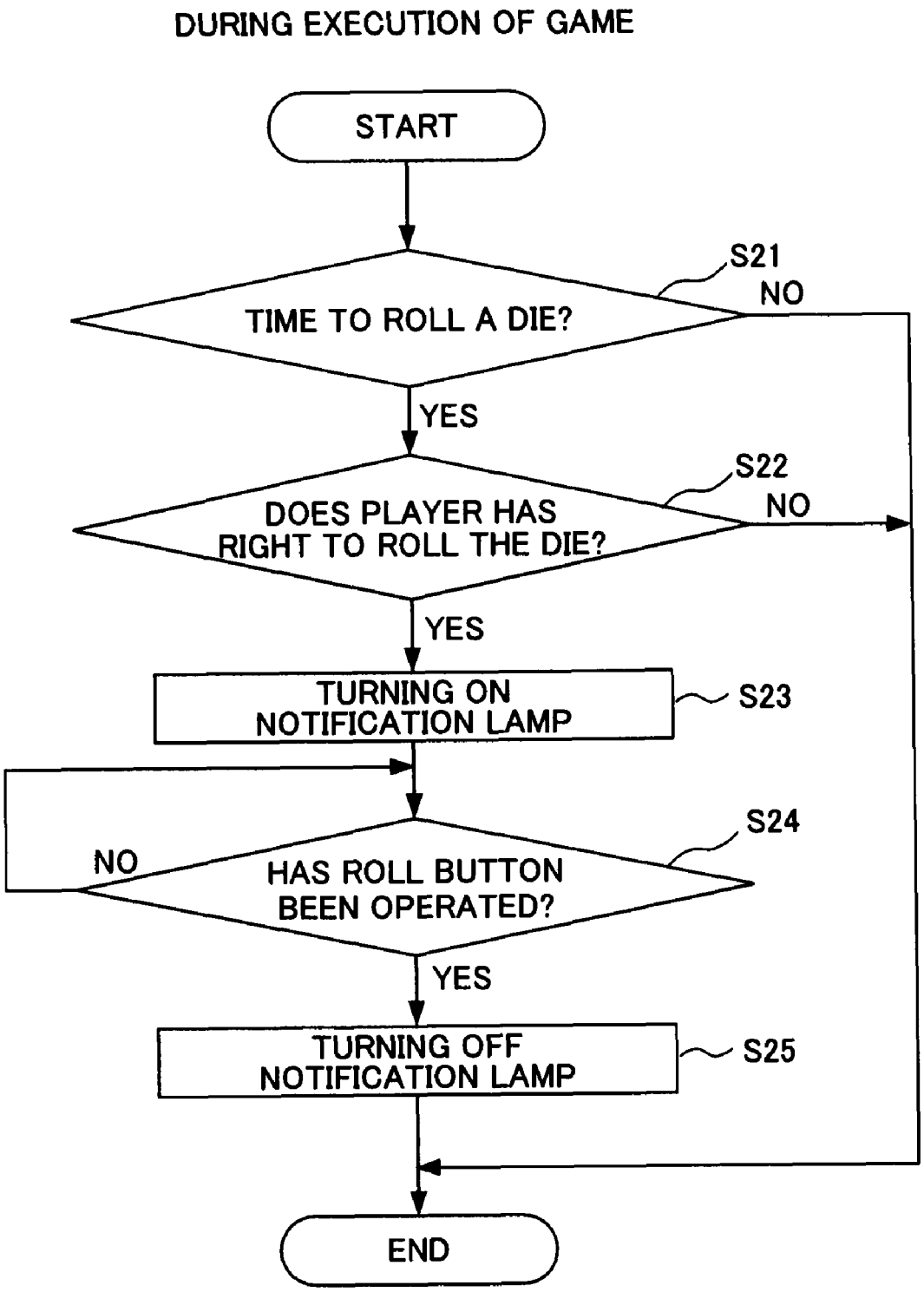
FIG. 18 is a diagram showing a flow of the operating unit during game execution in a case of playing Sic Bo according to the embodiment of the present invention.

A flow of processing by the gaming machine 1 is described hereinafter with reference to FIGS. 17 and 18. FIG. 17 is a diagram showing a main flow. FIG. 18 is a diagram showing a flow of the operating unit during game execution when performing Sic Bo.

Control of the main flow is described with reference to FIG. 17.

First, a CPU 61 of the gaming machine 1 illuminates the foot lamp 25 and the arm rest illuminating portion 37 (Step S1), and advances the processing to Step S2.

In Step S2, the CPU 61 determines whether the human body detection sensor 29 has detected a human body. In a case where the human body detection sensor 29 has detected a human body (in a case of YES determination), the processing is advanced to Step S3. In a case where the human body detection sensor 29 has not detected a human body (in a case of NO determination), the CPU 61 stands by.

In Step S3, the CPU 61 turns off the foot lamp 25 and the arm rest illuminating portion 37, and advances the processing to Step S4. As described above, the foot lamp 25 and the arm rest illuminating portion 37 are turned off when the human body detection sensor 29 responds (detects a human body) and are turned on when the human body detection sensor 29 does not respond (does not detect a human body).

In Step S4, the CPU 61 outputs a predetermined question from the speaker 51. The question is for confirming the use of the gaming machine 1, for example, "Would you like to play a game?" More specifically, the CPU 61 reads audio data stored in the ROM 63 and outputs the audio data from the speakers 51 of the application unit 5. When the processing is terminated, the CPU 61 advances the processing to Step S5.

In Step S5, the CPU 61 determines whether a player has responded or not. More specifically, the sound sensor 36 provided on the top door 3 detects sound, and the CPU 61 analyzes the sound to determine whether the sound is a predetermined response or not. In a case where the sound is the predetermined response (in a case of YES determination), the processing is advanced to Step S6. In a case where the sound sensor does not detect sound or the sound is not the predetermined response (in a case of NO determination), the processing is advanced to Step S2.

In Step S6, the CPU 61 displays a game window on the main display 31. Here, the game window is, for example, an image for accepting a bet and the like. In addition, in Step S7, the CPU 61 determines whether a bet is accepted or not. In a case where a bet is accepted (in a case of YES determination), the processing is advanced to Step S8. In a case where a bet is not accepted (in a case of NO determination), the CPU 61 stands by.

In Step S8, the CPU 61 switches between modes of illumination of the cabinet illuminating portion 24. The mode of illumination is required to be changed from the mode before the bet is made. For example, a change in modes is a change of light color, blinking, turning off or on of the light, and the like. In a case where the gaming machine 1 is installed in a semicircular arrangement or the like around a dealer, the dealer can recognize bets being made by the change in modes of illumination.

In Step S9, the CPU 61 starts executing a game. In Step S10, the CPU 61 determines whether the game is terminated or not. The LED portion 384 provided on both sides 2 of the top door 3 switches between the modes of illumination in accordance with a control signal from the CPU 61. In other words, a mode of light emitted by the LED portion 384 is changed (change in colors, turning on and off, blinking and the like). As used herein, the game is a unit in which a bet can be made. In a case where the game is terminated (in a case of YES determination), the CPU 61 advances the processing to Step S11, and in a case where the game is not terminated (in a case of NO determination), the CPU 61 continues executing the game until termination.

In Step S11, the CPU 61 performs payout of coins as necessary, and advances the processing to Step S12. In Step S12, the CPU 61 returns the mode of light of the cabinet illuminating portion 24.

In Step S13, the CPU 61 determines whether the human body detection sensor 29 is responding or not. In a case where the human body detection sensor 29 is responding and detecting a human body (in a case of YES determination), the processing is advanced to Step S6. On the other hand, in a case where the human body detection sensor 29 is not responding and not detecting a human body (in a case of NO determination), the processing is advanced to Step S14. In a case where the human body detection sensor 29 is detecting a human body even after the termination of the game, the player using the gaming machine 1 is considered to be willing to continue the game. Therefore, the CPU 61 can continue the game without returning to Step S4 for outputting the question from the speakers 51.

In Step S14, the CPU 61 terminates execution of the game and displays a demonstration screen on the main display 31. Since the human body detection sensor 29 does not detect a human body, a player is assumed to be away from the gaming machine 1. Therefore, the CPU 61 terminates the game and displays the demonstration screen. Upon finishing the processing, the CPU 61 terminates the flow.

Operation during execution of a Sic Bo game is described hereinafter with reference to FIG. 18. It should be noted that a flow shown in FIG. 18 is for a case where an operating unit 32*b* for a Sic Bo game is installed in the cabinet 2 as the operating unit 32. In addition, a die and a unit for rolling the die (hereinafter referred to as a dice unit) are assumed to be provided separately from the gaming machine 1.

In Step S21, the CPU 61 determines whether it is time to roll the die or not. More specifically, the CPU 61 determines whether a bet operation is terminated or not. In addition, in a case where a plurality of gaming machines 1 executes a game simultaneously, the CPU 61 determines whether the bet operation by all the players participating in the game is terminated or not. In addition, in a case where a plurality of gaming machines 1 executes a game simultaneously, the CPU 61 determines whether all the players participating in the game have terminated the bet operation.

In Step S22, the CPU 61 determines whether the player has the right to roll the die. Whether the player has the right to roll the die is determined by whether a predetermined condition is satisfied. In a case where the player has the right to roll the die (in a case of a YES determination), the processing is advanced to Step S23, and in a case where the player does not have the right to roll the die (in a case of a NO determination), the flow is terminated.

Here, the predetermined condition can be, for example, a player randomly selected from among players having bet at least a predetermined amount, a player having bet a maximum amount, a player having bet a maximum accumulated bet amount, a player completely randomly determined, a player having lost or won a large amount, and the like.

In Step S23, the CPU 61 illuminates the notification lamp 324 on the operating unit 32*b*. This notifies a player that the roll button 323 can be operated to start rolling the die. In addition, in a case where a plurality of gaming machines 1 executes a game simultaneously, the notification lamp 324 is turned on only for the gaming machine 1 used by a player having the right to roll the die in Step S22. By granting a right to roll the die to a player, the player can decide when to start rolling the die.

In Step S24, the CPU 61 determines whether the roll button 323 is operated or not. In a case where the roll button 323 is not operated (in a case of a YES determination), the CPU 61 advances the processing to Step S25, and in a case where the roll button 323 is not operated (in a case of a NO determination), the CPU 61 stands by.

In Step S25, the CPU 61 submits a signal to start rolling the die to the dice unit and turns off the notification lamp 324. Upon finishing the processing, the CPU 61 terminates the flow.

According to the present embodiment, for the case of detecting a player intending to operate the gaming machine 1, the human body detection sensor 29 provided on the lower side B of the sub housing portion 21 detects a human body, the speakers 51 output a question in response to a detection by the human body detection sensor 29, and then the sound sensor 36 detects a voice of the player, determines whether the voice is a predetermined sentence corresponding to an answer to the question by analyzing the voice, and recognizes the sentence. In this way, even if the human body detection sensor 29 responds to an object other than a human body (a player), a game will not start without the predetermined sentence being recognized by the sound sensor 36. This can prevent the gaming machine 1 from executing a game when a player is not operating the gaming machine 1.

While an embodiment of the gaming machine according to the present invention has been described, it is to be understood that the above description is intended to be illustrative, and not restrictive, and any changes in design may be made to specific configurations such as various means. Moreover, it should be understood that the advantages described in association with the embodiments are merely a listing of most preferred advantages, and that the advantages of the present invention are by no means restricted to those described in connection with the embodiments.

In the present embodiment, the card identification circuit 73 as the reader portion reads information stored in the player card inserted into the card slot 26, and a play history of the player is displayed on the player information display portion 27; however, the present invention is not limited thereto. For example, various gaming machines 1 in a game hall can be connected by a network and, in a case where a player card is inserted into the card slot 26, a play history corresponding to the player card can be read from a server and displayed on the player information display portion 27.

In the present embodiment, the foot lamp 25 and the arm rest illuminating portion 37 are turned on when the human body detection sensor 29 is not responding, and the foot lamp 25 and the arm rest illuminating portion 37 are turned off when the human body detection sensor 29 is responding; however, the present invention is not limited thereto. For example, the foot lamp 25 and the arm rest illuminating portion 37 can be turned on even when the human body detection sensor 29 is responding. In addition, the LED portion 384 on the cover member 38 can be similarly turned on and off. In a case where a player is seated at the front side F of the gaming machine 1, the light emitted from the foot lamp 25 and the arm rest illuminating portion 37 are hidden behind the player, thus providing the same effect as the abovementioned embodiment without a particular operation.

What is claimed is:

1. A gaming machine comprising:

a cabinet;

a door that is disposed to be openable and closable, and disposed on an upper portion of the cabinet;

a display device that visually, or auditorily and visually, presents information related to a game on a surface side of the door according to electrical control;

a control unit that is electrically connected with the display device via a signal line cable transmitting an electrical signal, executes a game based on a game program, and transmits the electrical signal for controlling the display device via the signal line cable in order to perform display according to a result of performing the game;

an input device that is connected with the control unit and can accept input related to a game;

a relay portion, which is a dummy of the control unit, disposed at a relay position along the signal line cable that connects the control unit with the display device;

a sub housing portion that houses the relay portion, in a state which is visually recognizable from an opening, wherein the opening is formed on an upper side of the sub housing when the door is opened; and a main housing portion that is disposed at a side of the sub housing portion, and houses the control unit, wherein the opening formed on an upper side of the sub housing is disposed on the main housing portion, wherein the sub housing portion and the main housing portion are divided by a dividing board that forms a bottom face of the sub housing portion other than a portion through which the signal line cable passes, and the portion of the signal line cable that connects the control unit with the relay portion is disposed at a location that is substantially visually hidden by the dividing board when the door is opened.

2. A gaming machine comprising:

a cabinet that houses devices which execute a game;

a top door that is openable and closable, and disposed on an upper portion of the cabinet;

a display that is disposed on the top door and performs display related to the game, and a control unit that is electrically connected with the display via a signal line cable transmitting an electrical signal, and executes the game, wherein:

the cabinet includes a main housing portion that houses the control unit and a sub housing portion that is provided between the main housing portion and the top door, and houses a relay portion that relays the display to the control unit, wherein the sub housing portion and the main housing portion are divided by a dividing board that forms a bottom face of the sub housing portion other than a portion through which the signal line cable passes, and the portion of the signal line cable that connects the control unit with the relay portion is disposed at a location that is substantially visually hidden by the dividing board when the door is opened.

3. The gaming machine as described in claim 2 further comprising on the top door:

a device that operates based on a signal from the control unit and a device that transmits a signal to the control unit, wherein the device that operates and the device that transmits are connected to the control unit via the relay portion.

4. The gaming machine as described in claim 2, further comprising an operating unit that is operable by a player, wherein the operating unit is connected to the control unit via the relay portion.

5. The gaming machine as described in claim 2, further comprising a rendering portion that generates light and sound based on a signal from the control unit, wherein the rendering portion is connected to the control unit via the relay portion.

6. The gaming machine as described in claim 2, further comprising:

an application unit that is disposed on the cabinet, operates in response to a signal from the control unit, and is detachable; and a connection portion that electrically connects the control unit with the application unit.

* * * * *